US008544188B2

(12) United States Patent
Kim et al.

(10) Patent No.: US 8,544,188 B2
(45) **Date of Patent: *Oct. 1, 2013**

(54) DRYER

(75) Inventors: Sungmin Kim, Seoul (KR); Jongseok Kim, Seoul (KR); Daeyun Park, Seoul (KR); Sogkie Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 371 days.

This patent is subject to a terminal disclaimer.

(21) Appl. No.: 12/892,446

(22) Filed: Sep. 28, 2010

(65) Prior Publication Data

US 2011/0072681 A1 Mar. 31, 2011

(30) Foreign Application Priority Data

Sep. 29, 2009 (KR) ..... 10-2009-0092568
Sep. 29, 2009 (KR) ..... 10-2009-0092569
Sep. 29, 2009 (KR) ..... 10-2009-0092570
Nov. 6, 2009 (KR) ..... 10-2009-0107007

(51) Int. Cl.
*F26B 11/00* (2006.01)

(52) U.S. Cl.
USPC ..... 34/595; 34/601; 34/606; 34/610; 68/210; 68/196; 28/116; 28/134

(58) Field of Classification Search
USPC ..... 34/105, 108, 595, 601, 606, 610; 366/69, 101, 104; 28/116, 134, 172.1; 68/196, 68/210, 24.58
See application file for complete search history.

(56) References Cited

U.S. PATENT DOCUMENTS 1,922,471 A * 8/1933 Cavanagh ..... 156/350
2,150,620 A * 3/1939 Frost ..... 220/9.2
2,193,495 A 3/1940 Rolkern
2,553,581 A 5/1951 Hatfield
2,603,832 A 7/1952 Clark et al.
2,617,203 A 11/1952 Murray (Continued)

FOREIGN PATENT DOCUMENTS

EP 1 619 285 1/2006
JP 02-241492 9/1990

(Continued)

OTHER PUBLICATIONS

U.S. Office Action issued in U.S. Appl. No. 12/892,426 dated Dec. 31, 2012.

(Continued)

*Primary Examiner* — Steve M Gravini
(74) *Attorney, Agent, or Firm* — KED & Associates, LLP

(57) ABSTRACT

A dryer is provided. The dryer may include a main body having an inner space formed therein, a support body arranged in the main body so as to form a frame of the main body, a flexible drum rotatably installed on the support body so as to have a non-circular cross-section as it is rotated, and rotation guides arranged between the support body and the flexible drum so as to guide rotation of the flexible drum. A distance from a center of rotation of an inscribed circle contacting the inner circumferential surface of the flexible drum to one random point on the inner circumferential surface of the flexible drum is greater than a distance from the center of rotation of the inscribed circle to another point on the inscribed circle such that the drum maintains a non-circular cross section.

33 Claims, 28 Drawing Sheets

(56) References Cited

U.S. PATENT DOCUMENTS

| | | | | |
|---|---|---|---|---|
| 2,645,108 | A | 7/1953 | Smith | |
| 3,017,758 | A * | 1/1962 | Haverstock et al. | 68/19 |
| 3,816,942 | A | 6/1974 | Smith | |
| 3,932,947 | A | 1/1976 | Smoot | |
| 4,007,546 | A * | 2/1977 | Sauer | 34/602 |
| 4,109,397 | A * | 8/1978 | Daily | 34/239 |
| 4,510,697 | A | 4/1985 | Beasley et al. | |
| 4,669,200 | A * | 6/1987 | Carr | 34/242 |
| 5,127,169 | A | 7/1992 | Ellingson | |
| 5,276,979 | A * | 1/1994 | Gordon, Sr. | 34/600 |
| 5,661,914 | A | 9/1997 | Millet | |
| 5,743,025 | A * | 4/1998 | Jordan, Jr. | 34/600 |
| 5,820,258 | A * | 10/1998 | Braun | 366/63 |
| 6,212,792 | B1 * | 4/2001 | Bier | 34/315 |
| 7,028,415 | B2 * | 4/2006 | Heinzen et al. | 34/312 |
| 7,117,613 | B2 | 10/2006 | Guinibert et al. | |
| 7,225,562 | B2 | 6/2007 | Guinibert et al. | |
| 7,762,007 | B2 | 7/2010 | Guinibert et al. | |
| 2011/0072679 | A1 | 3/2011 | Kim et al. | |
| 2011/0072680 | A1 * | 3/2011 | Kim et al. | 34/108 |
| 2011/0072681 | A1 * | 3/2011 | Kim et al. | 34/108 |
| 2011/0258872 | A1 * | 10/2011 | Kim et al. | 34/85 |

FOREIGN PATENT DOCUMENTS

| | | |
|---|---|---|
| JP | 2012-130474 | 7/2012 |
| JP | 2012-130475 | 7/2012 |
| WO | WO 2009-040854 | 4/2009 |

OTHER PUBLICATIONS

Office Action issued in U.S. Appl. No. 12/892,407 dated May 16, 2013.

International Search Report issued in PCT Application No. PCT/KR2010/006645 dated Jul. 26, 2011.

* cited by examiner

DRYER

CROSS-REFERENCE TO RELATED APPLICATION(S)

This application claims the benefit of Korean Application No. 10-2009-0092568 filed in Korea on Sep. 29, 2009, Korean Application No. 10-2009-0092569 filed in Korea on Sep. 29, 2009, Korean Application No. 10-2009-0092570 filed in Korea on Sep. 29, 2009, and Korean Application No. 10-2009-0107007 filed in Korea on Nov. 6, 2009, the disclosure of which is incorporated herein by reference.

BACKGROUND

1. Field

This relates to a fabric treatment apparatus, and more particularly to a dryer including a drum having an asymmetrical cross-section.

2. Background

In general, a dryer is an apparatus that dries wet fabric articles having been washed by a laundry treatment machine. Such a dryer may include a main body provided with an opened front surface, a drum rotatably provided in the main body to forcibly rotate fabric articles therein, and a drum driving device to drive the drum. As the wet fabric articles are forcibly rotated (tumbled) by the driving of the drum and heated air is blown to the inside of the drum, simultaneously, the wet fabric articles may be dried in a relatively short period of time. Maximum utilization of the inner space of the main body in accommodating the drum therein may increase drying capacity and efficiency.

BRIEF DESCRIPTION OF THE DRAWINGS

The embodiments will be described in detail with reference to the following drawings in which like reference numerals refer to like elements wherein.

DETAILED DESCRIPTION

Figure 1A:
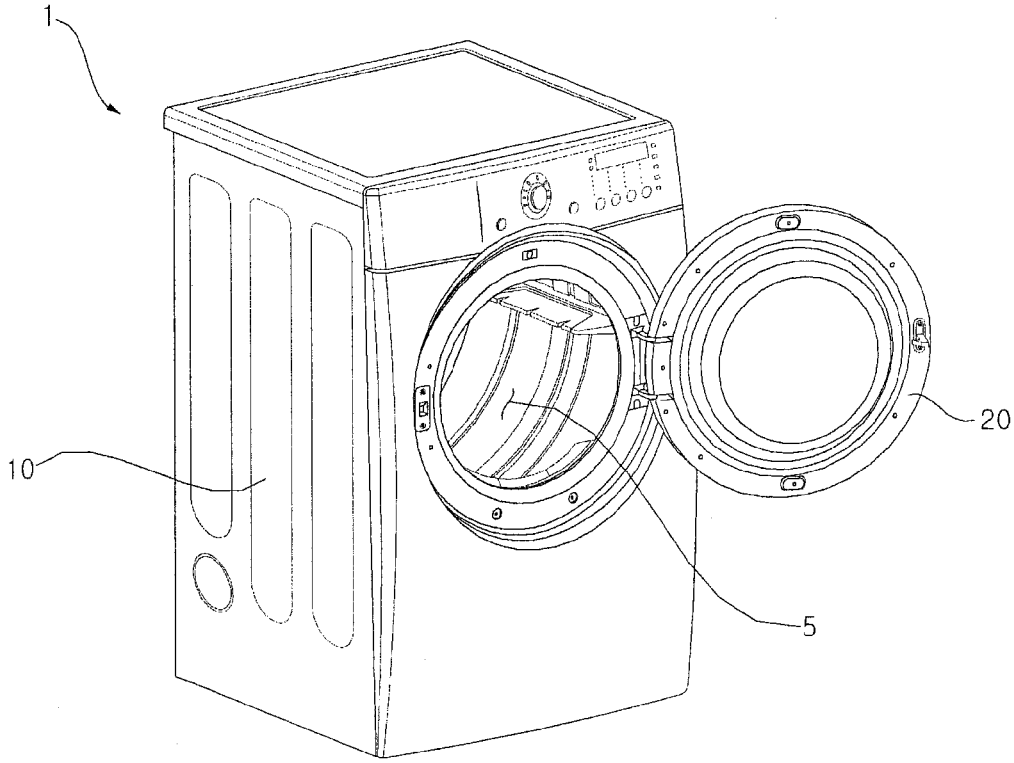
FIG. 1A is a perspective view of a dryer in accordance with an embodiment as broadly described herein.
Figure 1B:
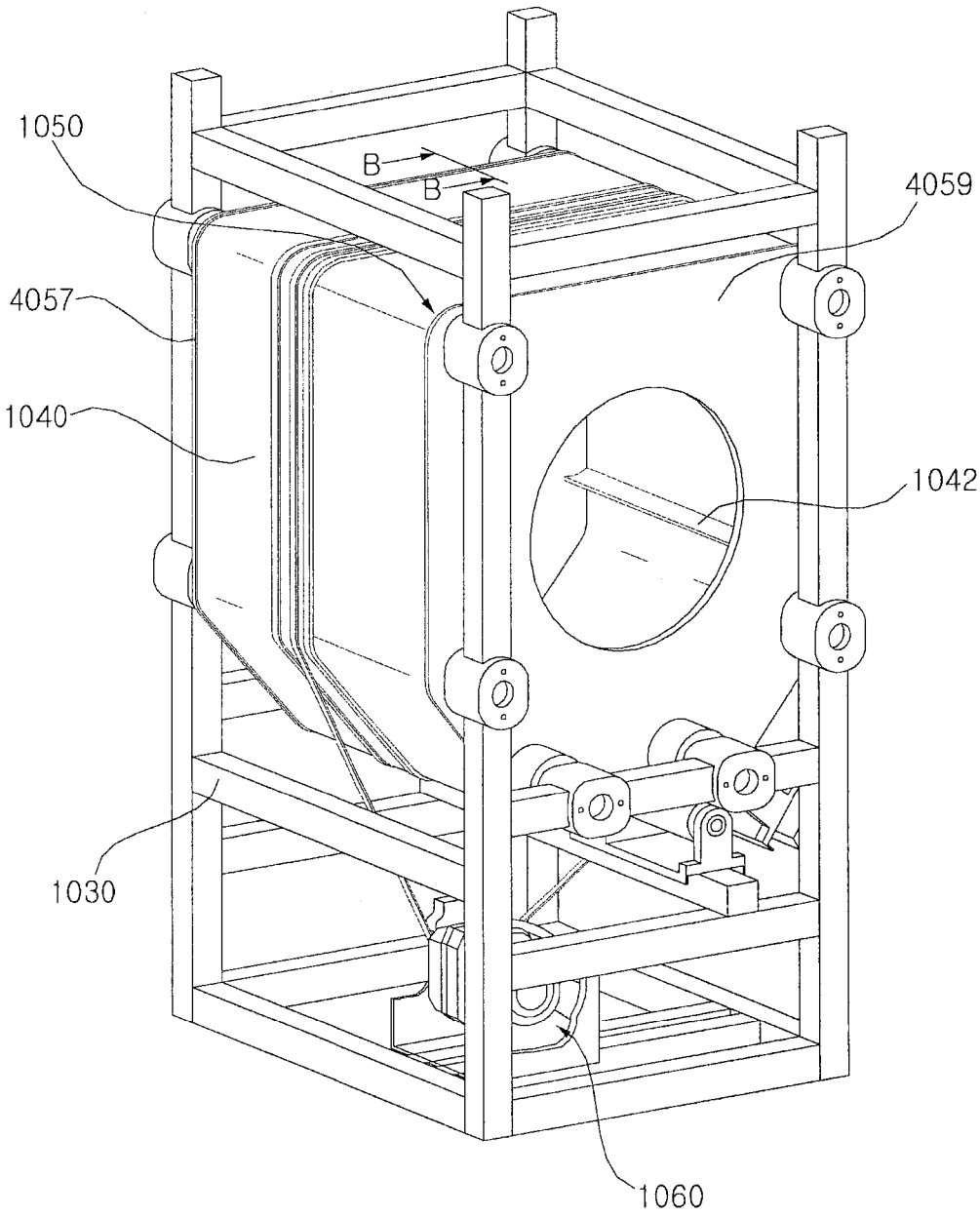
FIG. 1B is a perspective view of an internal structure of the dryer shown in FIG. 1A.

With reference to FIGS. 1A and 1B, a dryer 1 in accordance with one embodiment as broadly described herein may include a main body 10, or cabinet, forming the external appearance of the dryer 1, an opening 5 formed through a portion of the front surface of the main body 10, a door 20 to open and close the opening 5, a support body 1030 forming a frame of the main body 10, a flexible drum 1040 rotatably installed on the support body 1030, and rotation guides 1050 arranged between the support body 1030 and the flexible drum 1040 to guide rotation of the flexible drum 1040.

The main body 10 defines an inner space having a designated size, and, in the embodiment shown in FIG. 1A, the opening 5 is formed through the front surface of the main body 10. In this embodiment, the main body 10 has an approximately rectangular parallelepiped shape. The opening 5 serves as an entrance through which wet laundry may be inserted into the interior of the main body 10 or through which dry laundry may be removed from the interior of the main body 10. The door 20 may be rotatably installed on the front surface of the main body 10. The door 20 may open and close the opening 5 by hinging the lower end of the door 20 to the front surface of the main body 10 and rotating the upper end of the door 20 around the hinged upper end of the door 20. Alternatively, the front door 20 may open and close the opening 5 by hinging one of the left end or the right end of the door 20 to the front surface of the main body 10 and rotating the other one of the left end or the right end of the door 20 around the hinged left or right end of the door 20, as shown in FIG. 1A. Other coupling arrangements may also be appropriate.

In certain embodiments, the opening 5 may be formed in an approximately circular shape and have a circular cross-section, as shown in FIG. 1A. Alternatively, the opening 5 may be formed to have an asymmetrical circular cross-section, or other shape as appropriate. In more detail, for example, the upper portion of the opening 5 may have an approximately rectangular cross-section, and the lower portion of the opening 5 may have an approximately circular cross-section. The door 20 to open and close the opening 5 may have a shape corresponding to the shape of the opening 5, and the door 20 may open and close the opening 5 by hinging the left end of the door 20 to the left side of the front surface of the main body 10 and rotating the right end of the door 20 around the hinged left end of the door 20.

With reference to FIG. 1B, the support body 1030 may be installed in the interior of the main body 10. The support body 1030 may form the frame of the main body 10, and may have a size appropriate for installation on the inner surface of the main body 10 in the interior of the main body 10. In certain embodiments, the support body 1030 may be formed integrally with the main body 10. In FIG. 1B the main body 10 has been removed, simply for ease of illustration of the installation of the internal components. Hereinafter, the support body 1030 will be described as a frame provided at the inside of the main body 10. However, the support body 1030 is not limited thereto, but may be formed integrally with the main body 10 and/or a cabinet and/or a housing as appropriate.

As shown in FIG. 1B, the dryer 1 in accordance with this embodiment includes cover panels 4057 and 4059 to cover open rear and front faces of the flexible drum 1040, respectively. The cover panels 4057 and 4059 may be arranged between the frame 1030 and the flexible drum 1040, or may be formed as parts of the frame 1030 or the main body 10 as appropriate. The cover panels 4057 and 4059 will be described later with reference to FIGS. 16 and 17.

Figure 2A:
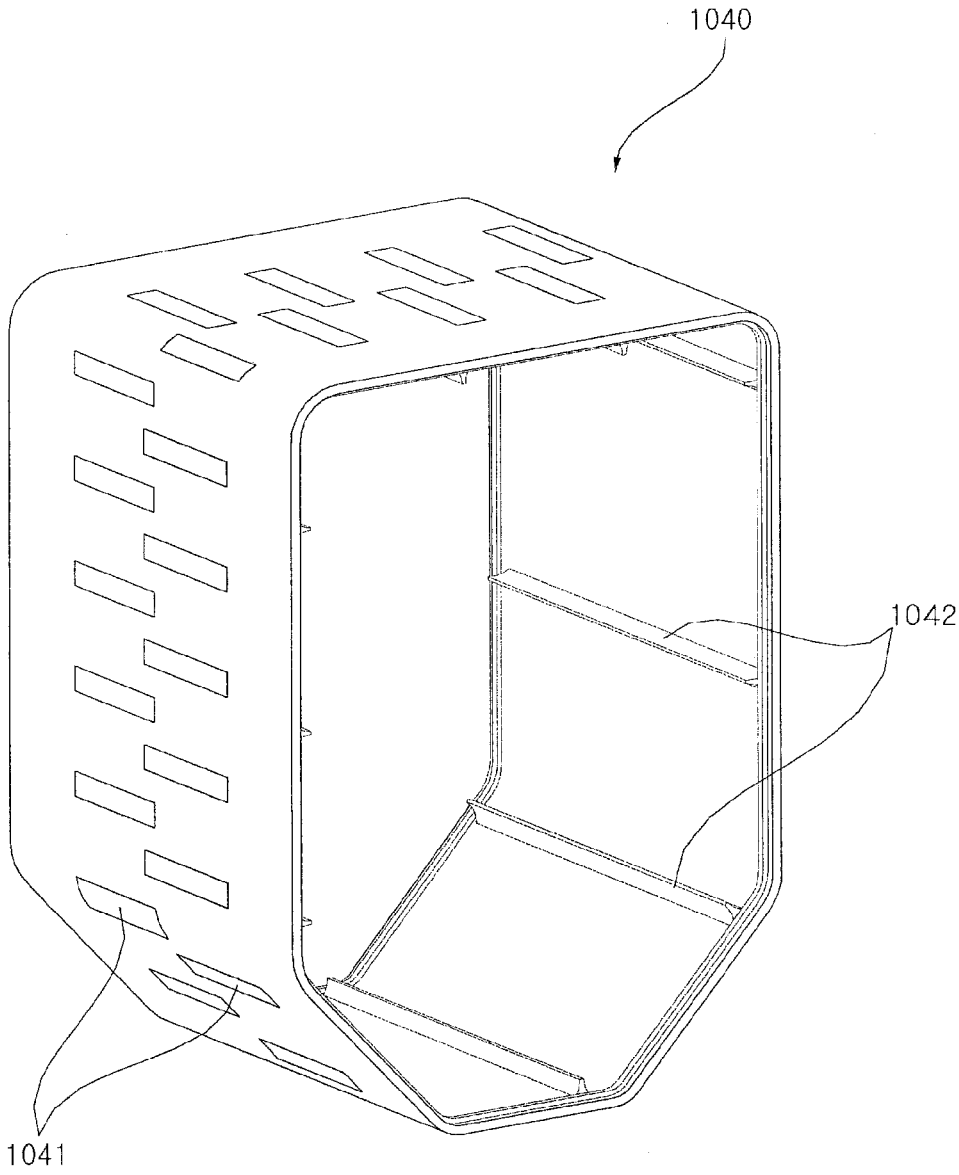
FIG. 2A is a perspective view of a flexible drum shown in FIG. 1B.
Figure 2B:
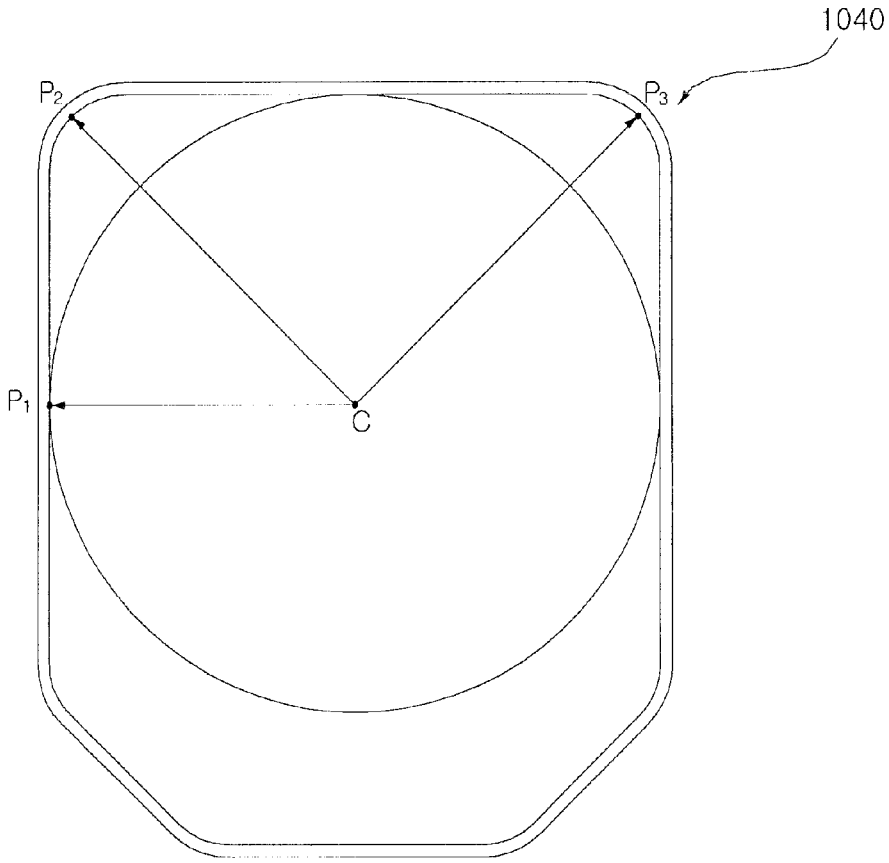
FIG. 2B is a front view of the flexible drum shown in FIG. 1B.

With reference to FIGS. 2A and 2B, the dryer 1 in accordance with an embodiment as broadly described herein may include the flexible drum 1040 rotatably installed on the frame 1030. The flexible drum 1040 is rotated to tumble wet laundry, received into the flexible drum 1040 through the opening 5, when the dryer 1 is operated. The flexible drum 1040 may include opened front and rear faces, and interconnected upper, lower and side surfaces to form a designated closed curve.

In some dryers, the drum may be made of a rigid material and have a hollow cylindrical shape with a closed rear surface, and a driving motor at the rear of the drum may rotate the drum, thereby achieving tumbling of the laundry. However, this type of arrangement does not make use of surplus spaces at corners of the main body 10 having an approximately rectangular parallelepiped shape. That is, since the main body 10 has an approximately rectangular parallelepiped shape, if a circular drum is arranged in the main body 10, dead spaces may occur at the corners of the main body 10. In order to make use of the dead spaces, a dryer 1 in accordance with an embodiment as broadly described herein includes the drum 1040 which is made of a flexible material and maintains a non-circular cross-section within the main body 10 even when the drum 1040 is rotated by a drum driving device 1060.

The flexible drum 1040 as shown in FIG. 2B is configured such that a distance from a center C of rotation of an inscribed circle contacting the inner circumferential surface of the flexible drum 1040 to one random point P2 or P3 on the inner circumferential surface of the flexible drum 1040 is greater than a distance from the center C of rotation of the inscribed circle to another point P1 on the inscribed circle.

If the shape of the flexible drum 1040 is described based on the virtual inscribed circle contacting the inner circumferential surface of the flexible drum 1040, as shown in FIG. 2B, the inscribed circle having a regular diameter first contacts the inner circumferential surface of the flexible drum 1040. The distance from the center C of rotation of the inscribed circle to the point P1 on the inscribed circle may be considered to be a regular diameter, i.e., the radius of the inscribed circle. The center C of rotation of the inscribed circle indicates a general center of the circle.

The distance from the center C of rotation of the inscribed circle to one random point P1, P2, or P3 on the inner circumferential surface of the flexible drum 1040 is irregular. That is, as the flexible drum 1040 has a non-circular cross-section, the distance from the center C of rotation of the inscribed circle to the random point P1, P2, or P3 on the inner circumferential surface of the flexible drum 1040 is varied based on a position of the one random point P1, P2, or P3. In this case, as the flexible drum 1040 is extended to the corners of the main body 10, which fall outside the inscribed circle, the distance from the random point P2 or P3 on the inner circumferential surface of the flexible drum 1040 corresponding to the corners of the main body 10 to the center or rotation C of the inscribed circle is greater than the radius of the inscribed circle, i.e., the distance to the point P, which is essentially tangential to the inscribed circle.

The point P1 of the flexible drum 1040 corresponding to two opposite lateral sides of the main body 10 may be equal to one random point of a circular drum as described above, and thus the distance from the random point P1 on the inner circumferential surface of the flexible drum 1040 to the center C of rotation of the inscribed circle is essentially equal to the radius of the inscribed circle.

Further, the random point P2 or P3 of the flexible drum 1040 corresponding to the corners of the main body 10 may be located at two corners, as shown in FIG. 2B, or in alternative embodiments at four corners of the main body 10. Thus there may be at least two random points P2 or P3 on the inner circumferential surface of the flexible drum 1040 having a distance from the center C of rotation thereto, which is greater than the distance from the center C of rotation to the point P1 on the inscribed circle. If the flexible drum 1040 is extended to two upper corners of the main body 10, as shown in FIG. 2B, the random point P2 or P3 on the inner circumferential surface of the flexible drum 1040 having the distance thereto from the center C of rotation, which is greater than the distance from the center C of rotation to the point P1 on the inscribed circle, is located at the two upper corners.

Figure 2C:
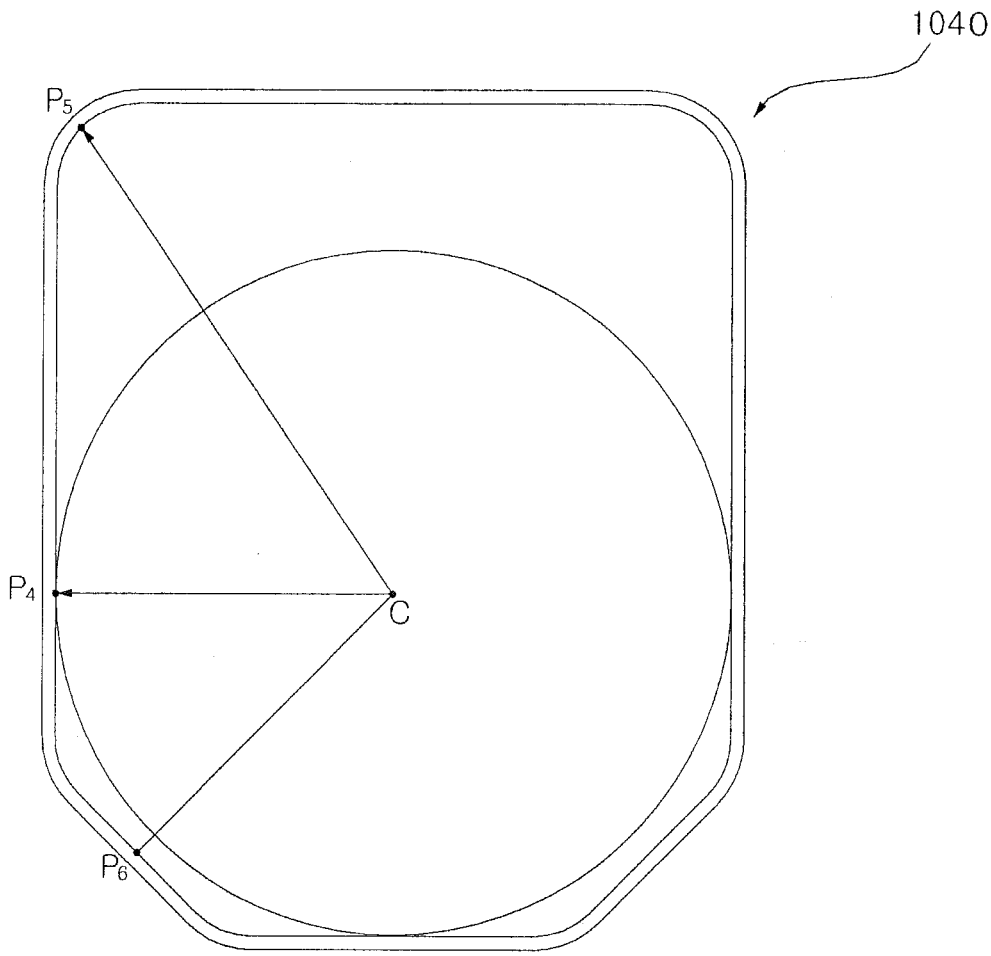
FIG. 2C illustrates an inscribed circle contacting the inner circumferential surface of a flexible drum in accordance with another embodiment as broadly described herein.

With reference to FIG. 2C, an inscribed circle in accordance with another embodiment contacts the lower portion of the flexible drum 1040. In this case, a distance from a center C of rotation of the inscribed circle contacting the inner circumferential surface of the flexible drum 1040 to one random point P5 or P6 on the inner circumferential surface of the flexible drum 1040 is greater than a distance from the center C of rotation of the inscribed circle to another point P4 on the inscribed circle. In this alternative, the random points P4, P5, or P6 are on the inner circumferential surface of the flexible drum 1040, and the distance between the random point P4, P5, or P6 and the center C of rotation of the inscribed circle is determined similarly to that in FIG. 2B.

There are many possible inscribed circles which are not shown in FIGS. 2B and 2C, in which a distance from a center C of rotation of an inscribed circle contacting the inner circumferential surface of the flexible drum 1040 to one random point on the inner circumferential surface of the flexible drum 1040 is greater than a distance from the center C of rotation of the inscribed circle to another point on the inscribed circle.

Figure 2D:
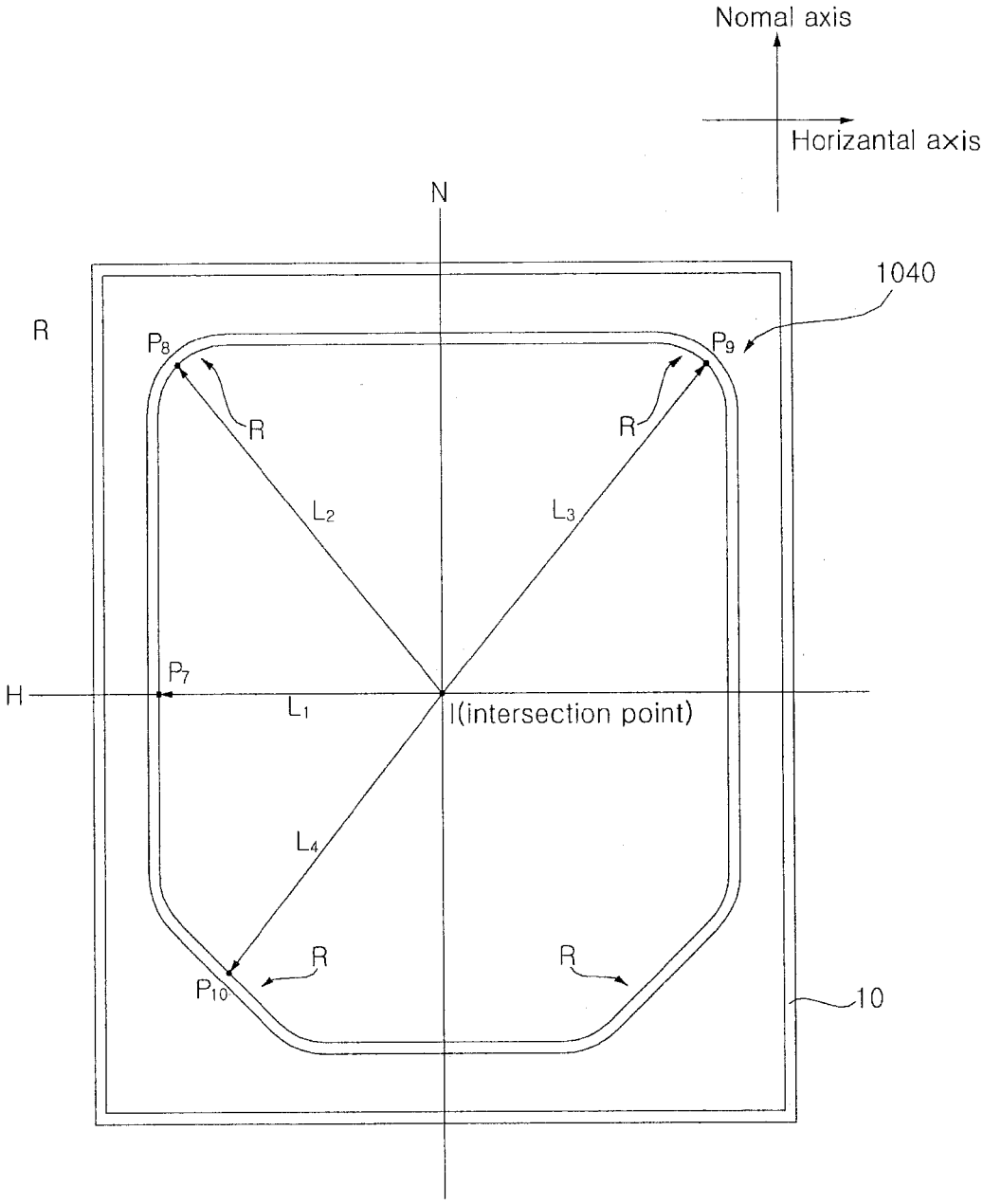
FIG. 2D illustrates the flexible drum positioned in a main body.

Alternatively, as shown in FIG. 2D, there may be, for example, two random points of the random points P7, P8, P9, or P10 on the flexible drum 1040 which have the longest distance thereto from an intersection point I between a bisection line N in a normal axis direction of the main body 10 and a bisection line H in a horizontal axis direction of the main body 10. In this case, the main body 10 may be defined as a circumscribed rectangle separated from the outer circumferential surface of the flexible drum 1040 by a designated interval along the edge of the flexible drum 1040. However, in certain embodiments, the main body 10 may contact the edge of the flexible drum 1040 without separation.

The intersection point I between the bisection line N in the normal axis direction of the main body 10 and the bisection line H in the horizontal axis direction of the main body 10 may be defined as a reference point, and a distance L1 from the reference point I to one of two opposite lateral sides of the flexible drum 1040 being parallel with a side of the main body 10 in the horizontal axis direction H is defined as a reference distance. Then, at least two of the points P8, P9, or P10 on the flexible drum 1040 may have a longer distance L2, L3, or L4 than the reference distance L1.

In this case, each of the above-described two points P8 and P9 may be one random point P8 or P9 located at corners of the flexible drum 1040 corresponding to the corners of the main body 10. The random point P8 or P9 may be located at each of the respective corners R. Therefore, four corners R are present, and thus the random one point is prepared in number of at least four.

Among the points located at the respective corners R, a curvature of the corner R at the point P8 or P9 having the longest distance from the intersection point I may differ from that of the corners R at other points. The point P8 or P9 having the longest distance from the intersection point I is located at each of the respective corners R. That is, curvatures of the respective corners R are different from each other, and thus the respective corners R are not parts of one circle having the same radius. Therefore, one point P8, P9, or P10 at the corner R of the flexible drum 1040 having the longest distance thereto from the intersection point I is located at each of the respective corners R.

The embodiment of the flexible drum 1040 shown in FIGS. 2B-2D has a hexagonal shape having six corners R. The respective corners R are curved, and thus the curved corners R are formed between the respective sides of the cross-section of the flexible drum 1040.

In the dryer 1 in accordance with embodied as broadly described herein, the flexible drum 1040 maintains a regular cross-section even if the flexible drum 1040 is rotated in the main body 10. Since the flexible drum 1040 is extended to regions adjacent to the corners of the main body 10 in the inner space of the main body 10, a greater amount of laundry may be put into the flexible drum 1040 and be dried in a relatively shorter period of time. Further, since unnecessary regions of the inner space of the main body 10 are minimized, an overall size of the dryer may be reduced while still providing a given capacity, thereby increasing design efficiency.

The flexible drum 1040 may be, for example, a relatively large-width belt rotated by the drum driving device 1060, and may be made of an appropriate material such as, for example, rubber so as to easily tumble wet laundry on the inner surface of the rotated flexible drum 1040 using friction. Other flexible materials, such as, for example, PVC or polyurethane (PU) may also be used.

Since the flexible drum 1040 is made of a flexible material, the shape of the drum 1040 may be deformed due to rotation, possibly affecting durability of the flexible drum 1040. Thus, rigid members 1041 may be attached to the outer surface of the flexible drum 1040 as long as the rigid members 1041 do not interfere with rotation of the flexible drum 1040. The rigid members 1041 may be made of any material having greater rigidity than the material for the flexible drum 1040. For example, the rigid members 1041 may be steel plates or rubber plates having a relatively small thickness and relatively good elasticity.

As shown in FIG. 2A, a plurality of rigid members 1041 may be arranged on the outer surface of the flexible drum 1040. The plurality of rigid members 1041 may be arranged in two lines on the outer surface of the of the flexible drum 1040, with a first line along a front portion and a second line along a rear portion of the flexible drum 1040. The first and second lines of the rigid members 1041 of the flexible drum 1040 may overlap each other to some degree, if appropriate, as shown in FIG. 2A.

The dryer 1 may also include lifters 1042 that extend front to rear on the inner surface of the flexible drum 1040. The lifters 1042 may protrude toward a central portion of the drum 1040 by a designated length to facilitate the tumbling of the laundry as the drum 1040 rotates. The lifters 1042 may be fused to the inner surface of the flexible drum 1040, or may be connected to the inner surface of the flexible drum 1040 by fastening members, such as screws. Other connection methods may also be appropriate.

It is noted that the flexible drum as embodied and broadly described herein is, simply for ease of discussion, applied to an exemplary dryer. However, the flexible drum may be applied to other laundry treatment machines which would benefit from the increased capacity provided by such a flexible drum, such as, for example, a washing machine.

With reference to FIGS. 3A-3B and 4A-4B, the dryer 1 may also include rotation guides 1050 or 1150, respectively, to support the flexible drum 1040 installed in the inner space of the main body 10 so that the flexible drum 1040 maintains a non-circular cross-section as it rotates within the main body 10. The rotation guides 1050 or 1150 may support the flexible drum 1040 so that a distance from the center C of rotation of an inscribed circle contacting the inner circumferential surface of the flexible drum 1040 to at least one point on the inner circumferential surface of the flexible drum 1040 is greater than a distance from the center C of rotation of the inscribed circle to another point on the inscribed circle, thus generating a non-circular cross section. That is, the rotation guides 1050 or 1150 support the flexible drum 1040, thereby enabling the flexible drum 1040 to maintain the above-described shape. In this case, a part of the rotation guide 1050 or 1150 withstands the load of the flexible drum 1040, thereby supporting the flexible drum 1040 so as to maintain the non-circular cross-section of the flexible drum 1040.

The rotation guides 1050 or 1150 may be installed between the frame 1030 and the flexible drum 1040. One side of each rotation guide 1050 or 1150 may contact the inner surface of the flexible drum 1040, and thus supports the flexible drum 1040 so as to achieve the above-described non-circular cross-section and guides rotation of the flexible drum 1040 so as to rotate the flexible drum 1040 while maintaining the non-circular cross-section of the flexible drum 1040. The other side of each rotation guide 1050 or 1150 may be positioned along the edge of the cover panel 4057 or 4059. If the cover panels 4057 and 4059 are formed integrally with the frame 1030, the rotation guides 1050 or 1150 may be fixed to the frame 1030.

A plurality of rotation guides 1050 or 1150 may be arranged between the frame 1030 and the flexible drum 1040 so as to guide rotation of the flexible drum 1040 at a plurality of positions. For example, a rotation guide 1050 or 1150 may be provided at each of the corners R of the drum 1040.

Further, the rotation guides 1050 or 1150 may be continuously provided along the edges of the cover panels 4057 and 4059 to provide a specifically desired shape. For example, a continuous track of rotation guides 1050 and 1150 could be positioned so as to produce a cross section which corresponds to the inner space of the main body 10, or even a circular cross section if desired.

Each rotation guide 1050 or 1150 may include a rolling part 1051 or 1151 that contacts and supports a part of the front end or the rear end of the flexible drum 1040, and an installation part 1052 or 1152 in which the rolling part 1051 or 1151 is installed. If the rotation guides 1050 or 1150 are continuously provided along the edges of the cover panels 4057 and 4059, the rolling parts 1051 or 1151 may be provided at a plurality of positions within the continuous rotation guides 1050 and 1150.

The installation parts 1052 or 1152 may be respectively fixed to the frame 1030, or may be continuously and integrally provided along the edges of the cover panels 4057 and 4059 installed in the inner space of the main body 10 and fixed to the frame 1030, with an appropriate portion thereof coupled to the drum 1040 and extending into the drum 1040 as necessary.

A portion of the installation part 1052 or 1152 which directly contacts laundry, i.e., a portion of the installation part 1052 or 1152 which is located at the inner surface of the flexible drum 1040, may be formed so as to surround the rolling part 1051 or 1151 and prevent contact between the rolling part 1051 and 1151 and the laundry in the drum 1040.

The rolling parts 1051 or 1151 may support the inner surface of the rotated flexible drum 1040 so as to facilitate rotation of the flexible drum 1040, and may be positioned at the front and/or rear end of the flexible drum 1040. The rolling parts 1051 or 1151 may be rotated about rotary shafts 1055 or 1155 thereof fixed to the main body 10, and the outer circumferential surfaces of the rotated rolling parts 1051 or 1151 contact the front end and/or the rear end of the flexible drum 1040, thereby enabling the rolling parts 1051 or 1151 to guide/support rotation of the flexible drum 1040.

The rolling parts 1051 or 1151 may also maintain a particular cross-section, i.e., a polygonal cross-section, of the rotated flexible drum 1040 when positioned appropriately. That is, although the shape of the flexible drum 1040 may be minutely changed during rotation of the flexible drum 1040, the rolling parts 1051 or 1151 maintain the regular polygonal cross-section while firmly guiding/supporting rotation of the flexible drum 1040.

The rotary shaft 1055 or 1155 of the rolling part 1051 or 1151 may be installed directly on the installation part 1052 or 1152, or the rotary shaft 1055 or 1155 of the rolling part 1051 or 1151 installed on the frame 1030 may pass through the installation part 1052 or 1152 so that the rotary shaft 1055 or 1155 of the rolling part 1051 or 1151 is installed indirectly on the installation part 1052 or 1152.

Regardless of the detailed structure of the rotation guides 1050 or 1150, the dryer 1 in accordance with embodiments as broadly described herein is characterized in that the drum 1040 is made of a flexible material and may have various shapes, and the non-circular cross-section of the drum 1040 may be maintained by the rotation guides 1050 or 1150 during rotation of the drum 1040. Such a dryer 1 may allow a greater amount of laundry to be received in the drum 1040 compared with a drum having a circular cross section, which generates dead spaces at corners of the main body 10, thus allowing a greater amount of laundry to be easily dried. Such a dryer 1 may more efficiently utilize spaces at the corners of the main body 10, thereby improving design efficiency and product size.

Hereinafter, the rotation guides 1050 and 1150 and detailed configurations thereof, in accordance with embodiments, will be described with reference to FIGS. 3A and 3B and FIGS. 4A and 4B.

Figure 3A:
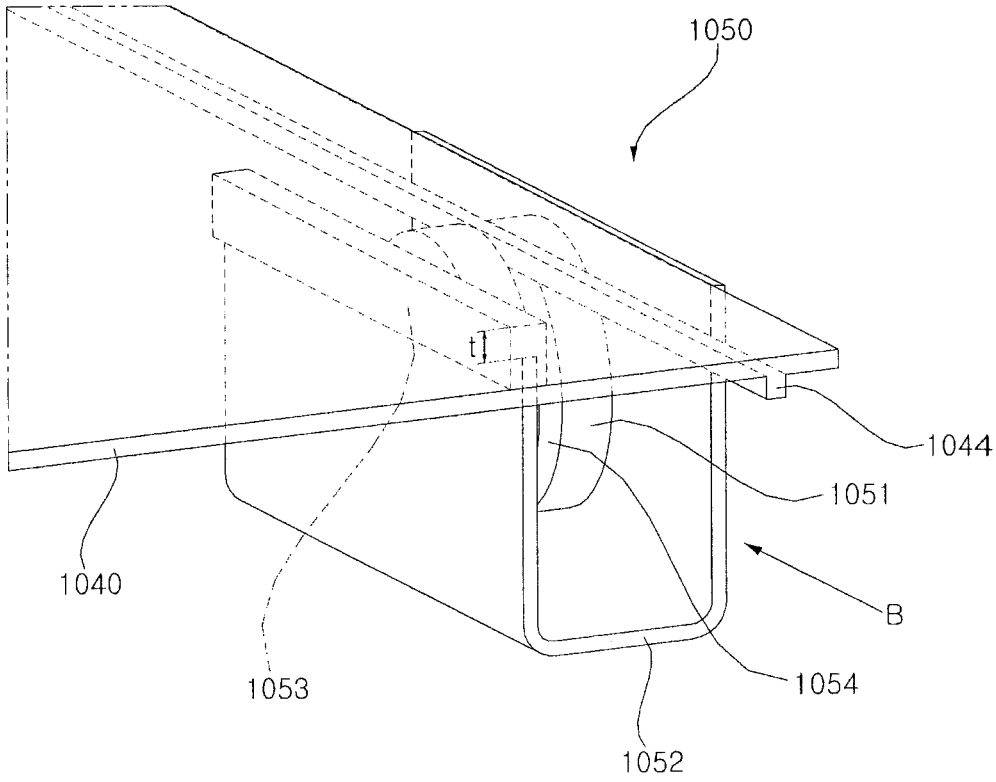
FIG. 3A is a perspective view of a rotation guide in accordance with an embodiment as broadly described herein.
Figure 3B:
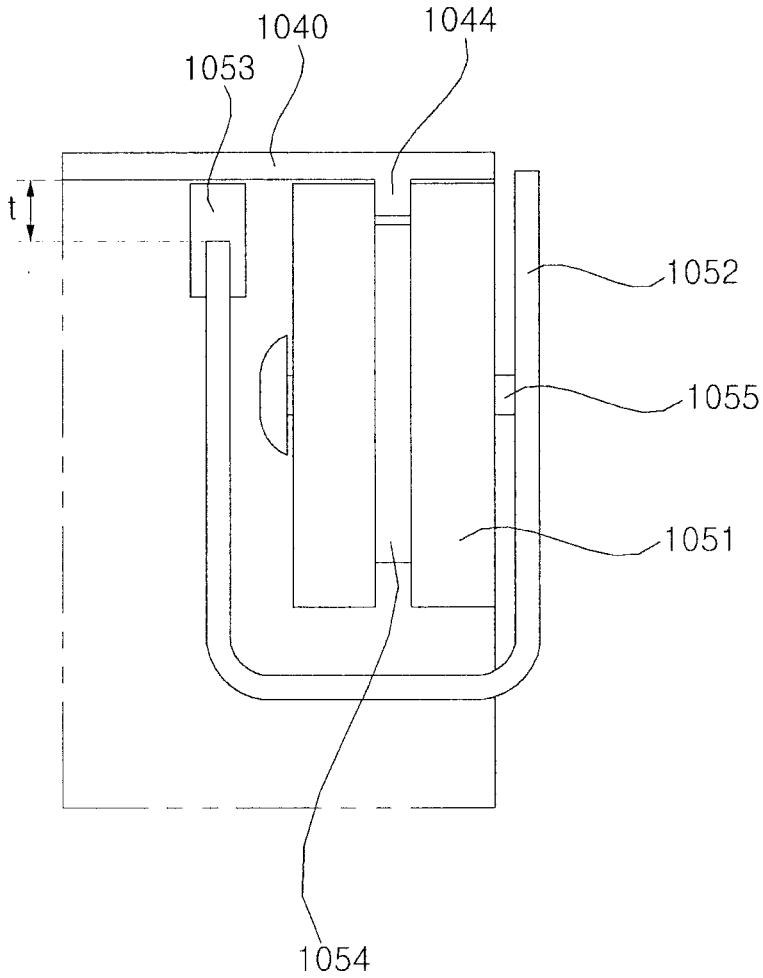
FIG. 3B is a front view of the rotation guide FIG. 3A.

In the rotation guide 1050 shown in FIGS. 3A and 3B, the rolling part 1051 contacts a part of the front end and/or the rear end of the inner surface of the flexible drum 1040, and thus supports the flexible drum 1040 by exerting a rolling force thereon directed toward the outside of the flexible drum 1040. In such a manner, the rolling part 1051 supports the inner surface of the flexible drum 1040, made of the flexible material, with an outwardly directed force, thereby tightly supporting the flexible drum 1040 and thus guiding rotation of the flexible drum 1040 while maintaining the non-circular cross-section of the flexible drum 1040. The rolling parts 1051 performing the above function may be arranged at a plurality of positions at the front end and the rear end of the frame 1030 as appropriate.

A guide rib 1044 to prevent the flexible drum 1040 from being separated from the rolling parts 1051 during rotation of the flexible drum 1040 may be formed on the inner surface of each of the front end and the rear end of the flexible drum 1040. The guide rib 1044 may protrude from an inner surface of the flexible drum 1040 toward the rolling parts 1051 by a designated length. The guide ribs 1044 may be manufactured as separate parts and attached to the inner surface of the flexible drum 1040. Alternatively, the guide ribs 1044 may be formed integrally with the flexible drum 1040 when the flexible drum 1040 is processed/manufactured.

A guide groove 1054, into which the guide rib 1044 is inserted during rotation of the flexible drum 1040, may be formed on the rolling part 1051. The guide groove 1054 may be formed at a portion of the rolling part 1051 contacting the flexible drum 1040, i.e., formed along a portion of the outer circumferential surface of the rolling part 1051 that contacts the guide rib 1044. The guide groove 1054, into which the guide rib 1044 is inserted during rotation of the flexible drum 1040, serves both to tightly pull the flexible drum 1040 forwards or rearwards and to prevent the flexible drum 1040 from being separated from the rolling part 1051 in a forwards or rearwards direction.

The rolling part 1051 is installed in the installation part 1052 arranged on the frame 1030, and thus is isolated from the outside except for a portion of the rolling part 1051 contacting the flexible drum 1040. This prevents laundry tumbling in the flexible drum 1040 from being caught in the rolling part 1051, or small foreign substances or lint, generated by the laundry, from being caught in the rolling part 1051.

The flexible drum 1040 is configured so as to be efficiently rotated, while the installation part 1052 is configured so as to isolate the rolling part 1051 and prevent laundry or small foreign substances or lint from being caught in the rolling part 1051, as described above. Thus, a tolerance of a certain degree between the formed end of the installation part 1052 and the flexible drum 1040 may be formed to allow for some flexibility of the drum 1040 during rotation. However, a gap between the formed end of the installation part 1052 covering the rolling part 1051 and the flexible drum 1040 may be as small as possible so as not to disturb the function of the installation part 1052.

For this purpose, a sealer 1053 may be provided on the rotation guide 1050. The sealer 1053 may be interposed between the flexible drum 1040 and the end of installation part 1052 of the rotation guide 1050 to seal the gap between the flexible drum 1040 and the rotation guide 1050, thereby preventing foreign substances from being caught in the rolling part 1051. The sealer 1053 may be inserted onto the end of the installation part 1052. Further, the sealer 1053 may be provided such that one side of the sealer 1053 is fixed to the rotation guide 1050 and the other side of the sealer 1053 contacts the inner circumferential surface of the flexible drum 1040. Further, one end of the sealer 1053 may be fixed to the installation part 1052 and the other end of the sealer 1053 may contact the inner surface of the flexible drum 1040 so as to hermetically seal the gap between the flexible drum 1040 and the installation part 1052.

The sealer 1053 may fill the gap between the flexible drum 1040 and the installation part 1052 while not influencing rotation of the flexible drum 1040 due to friction between the sealer 1053 and the flexible drum 1040, even if the flexible drum 1040 is rotated and thus contacts the sealer 1053. Therefore, the sealer 1053 may be made of a material having a relatively low coefficient of friction. In more detail, the sealer 1053 may be made of, for example, fabric, rubber having a low coefficient of friction, a polymer compound having a low coefficient of friction, or other material as appropriate. Further, the sealer 1053 may have a brush type configuration arranged at the end of the installation part 1052.

Figure 4A:
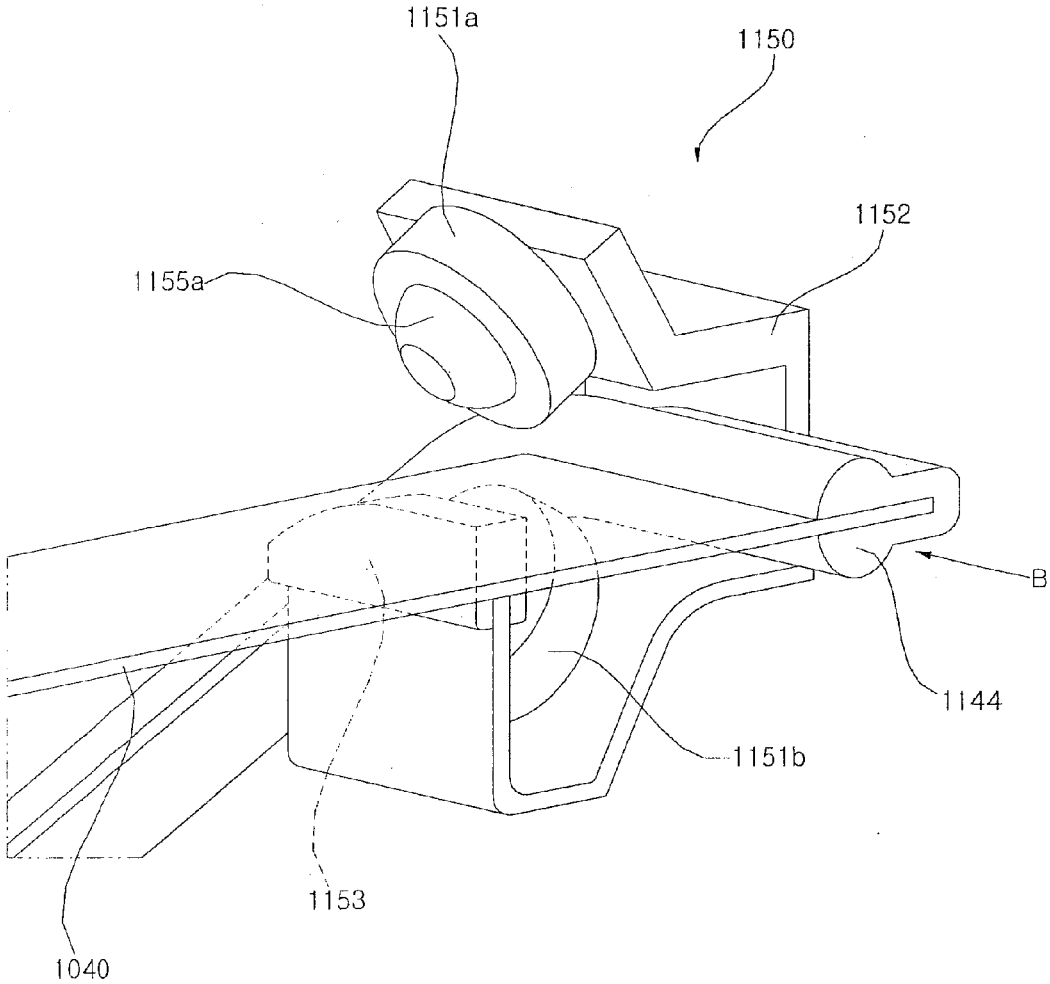
FIG. 4A is a perspective view of a rotation guide in accordance with another embodiment as broadly described herein.
Figure 4B:
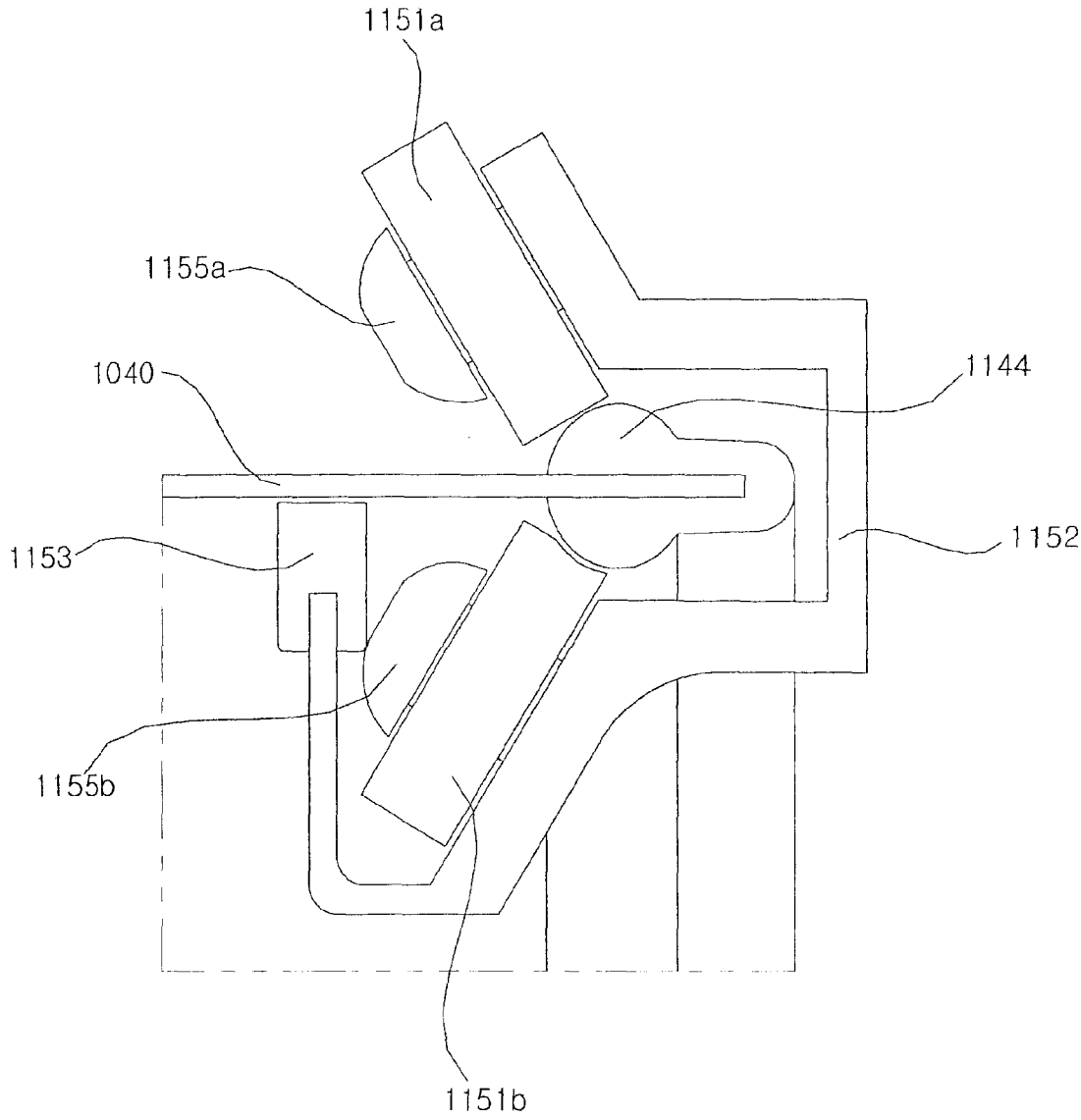
FIG. 4B is a front view of the rotation guide shown in FIG. 4A.

In the rotation guide 1150 shown in FIGS. 4A and 4B, the installation part 1152 is arranged so as to surround a part of the front end and/or the rear end of the flexible drum 1040. A first rolling part 1151*a* may contact a part of the front end and/or the rear end of the outer surface of the flexible drum 1040 to support the flexible drum 1040 toward the outside of the flexible drum 1040, and a second rolling part 1151*b* may contact a part of the front end and/or the rear end of the inner surface of the flexible drum 1040 to support the flexible drum 1040 toward the outside of the flexible drum 1040.

The first rolling part 1151*a* and the second rolling part 1151*a* may be arranged on a first rotary shaft 1155*a* and a second rotary shaft 1155*b* arranged at upper and lower portions of the installation part 1152, respectively. The first rotary shaft 1155*a* and the second rotary shaft 1155*b* may be arranged such that the first rolling part 1151*a* and the second rolling part 1151*b* are tilted at an angle of, for example, about 45°, with respect to the flexible drum 1040.

An anti-separation protrusion 1144 to prevent the flexible drum 1040 from being separated from the first rolling part 1151*a* and the second rolling part 1151*b* may be formed at each of the front end and the rear end of the flexible drum 1040. The anti-separation protrusions 1144 may be formed integrally with the flexible drum 1040, or may be manufactured separately from the flexible drum 1040 and then connected/fixed to the front end and the rear end of the flexible drum 1040. The anti-separation protrusions 1144 may serve as parts contacting the rolling parts 1151*a* and 1151*b* and supporting rotation of the rolling parts 1151*a* and 1151*b*.

In the rotation guide 1150 of the embodiment shown in FIGS. 4A and 4B, in order to prevent laundry or small foreign substances or lint from being caught in the second rolling part 1151*b* arranged at the inner surface of the flexible drum 1040, a sealer 1153 may be arranged between the installation part 1152 and the flexible drum 1040 in a similar manner as in the embodiment shown in FIGS. 3A and 3B. The sealer 1153 may be inserted onto one end of the installation part 1152 and may be made of a material having a low coefficient of friction similar to the embodiment shown in FIGS. 3A and 3B. Thus, further detailed description thereof will be omitted.

As described above, in the rotation guide 1150 in accordance with the embodiment shown in FIGS. 4A and 4B, the first rolling part 1151*a* and the second rolling part 1151*b*, arranged in a tilted state, guide rotation of the flexible drum 1040 while holding the outer surface and the inner surface of the front end or the rear end of the flexible drum 1040 outwards, and thus guide ribs and guide grooves described in the embodiment shown in FIGS. 3A and 3B are not required in this embodiment. Therefore, the rotation guide 1150 in accordance with the embodiment shown in FIGS. 4A and 4B may more firmly guide rotation of the flexible drum 1040 using a simpler design.

Figure 5A:
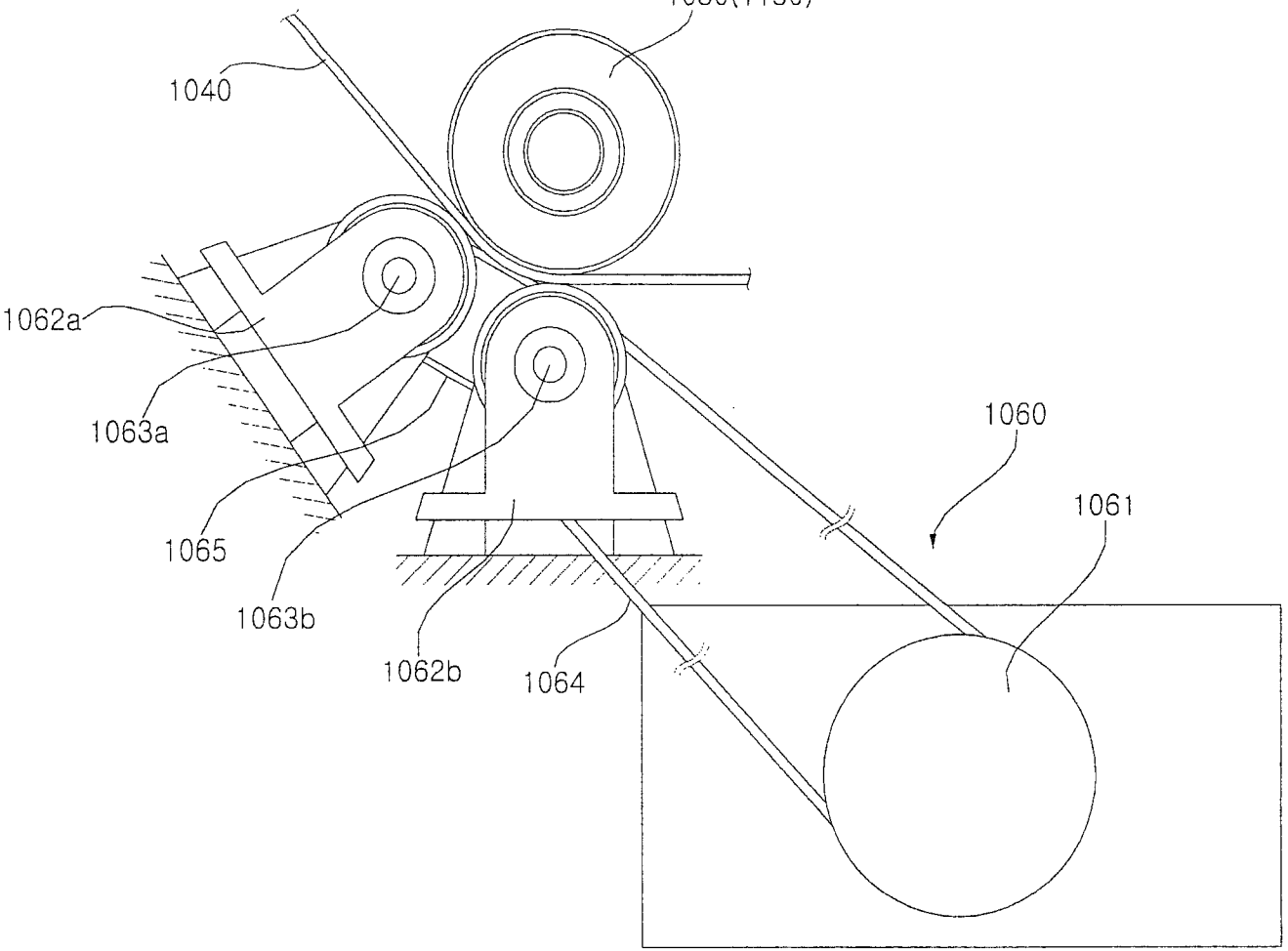
FIG. 5A illustrates a drum driving device in accordance with an embodiment as broadly described herein.
Figure 5B:
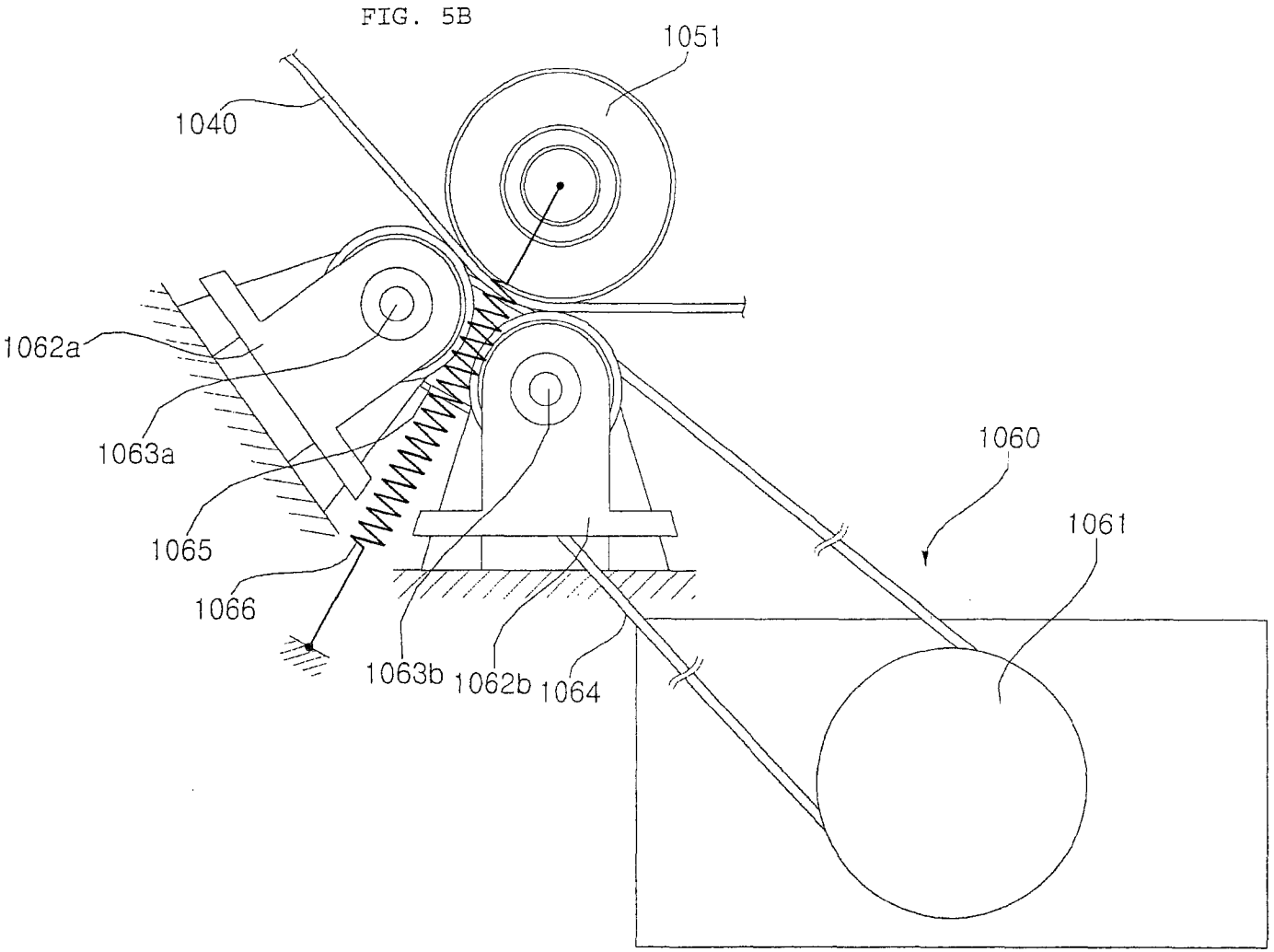
FIG. 5B illustrates a drum driving device in accordance with another embodiment as broadly described herein.
Figure 6:
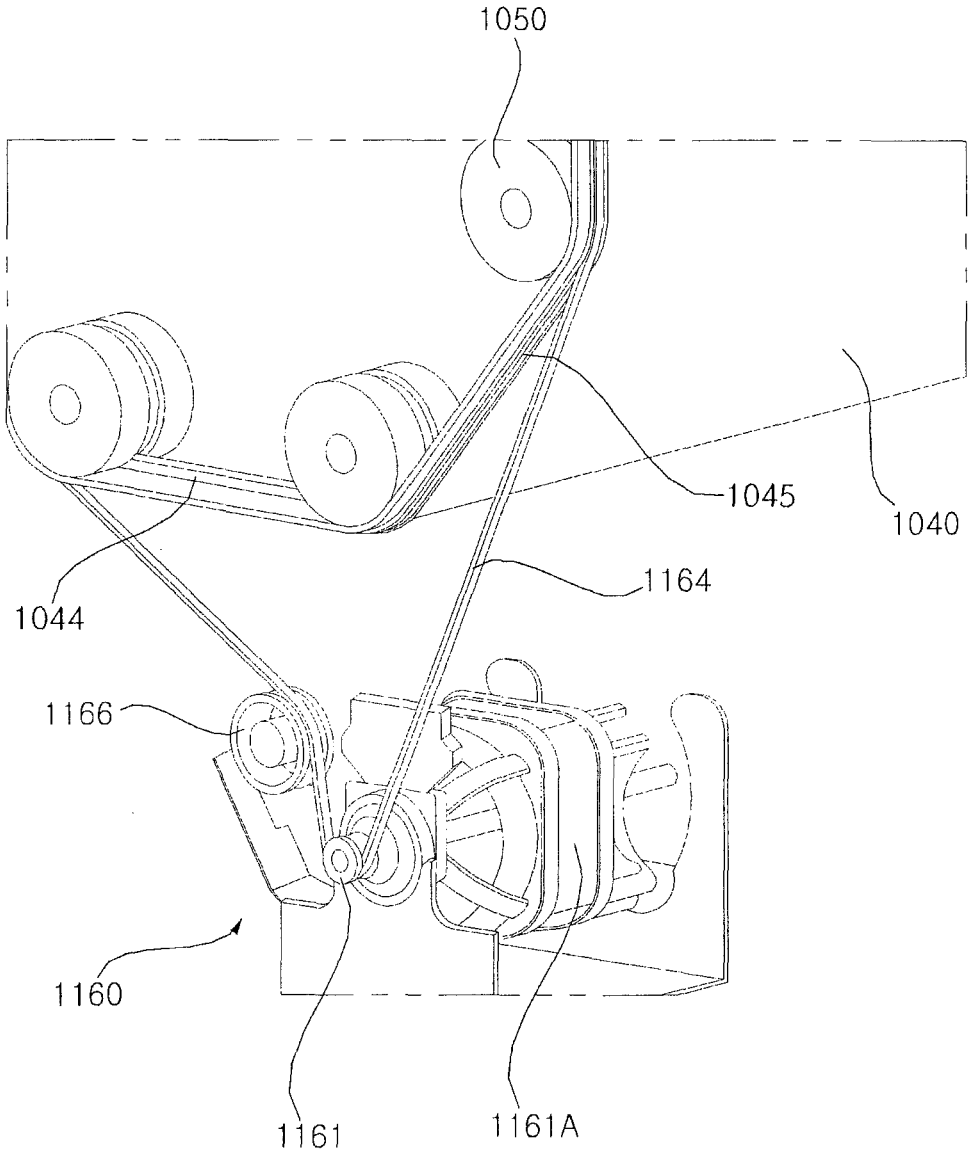
FIG. 6 is a perspective view of a drum driving device in accordance with another embodiment as broadly described herein.

With reference to FIGS. 5A and 5B and FIG. 6, the dryer 1 in accordance with an embodiment as broadly described herein may include a drum rotating device 1060 installed in the inner space of the main body 10 to rotate the flexible drum 1040.

In the embodiment shown in FIGS. 5A and 5B, the drum driving device 1060 includes a driving motor installed in the inner space of the main body 10, a driving pulley 1061 connected to a rotary shaft of the driving motor, and rotary members including driving rollers 1063*a* and 1063*b* rotated in connection with the driving pulley 1061 to rotatably support the outer surface of the flexible drum 1040 rotated by the rotation guides 1050 or 1150.

The driving motor may be arranged at, for example, the front region or the rear region of, for example, the lower portion of the inner space of the main body 10. The driving pulley 1061 may be installed at the rotary shaft of the driving motor so as to be rotated in connection with operation of the driving motor. A first driving belt 1064 may be wound in a groove formed on the driving pulley 1061.

The first driving roller 1063*b* may contact the outer surface of the flexible drum 1040, and may be connected with the driving pulley 1061 by the first driving belt 1064. The second driving roller 1063*a* may contact the outer surface of the flexible drum 1040, and may be connected with the first driving roller 1063*b* by a second driving belt 1065. The first driving roller 1063*b* and the second driving roller 1063*a* may be rotatably installed on mounting brackets 1062*b* and 1062*a*, respectively, which may be fixed to the frame 1030 or other such support structure as appropriate.

When the driving motor is operated, the driving pulley 1061 is rotated in connection with operation of the driving motor, rotary force of the driving pulley 1061 is transmitted to the first driving roller 1063*b* by the first driving belt 1063, and then rotary force of the first driving roller 1063*b* is transmitted to the second driving roller 1063*a* by the second driving belt 1065.

The first driving roller 1063*b* and the second driving roller 1063*a* are positioned opposite the outer circumferential surface of the rolling part 1051 of the rotation guide 1050, with the front end or the rear end of the flexible drum 1040 interposed between the first driving roller 1063*b*/second driving roller 1063*a* and the rolling part 1051. In this arrangement, the rolling part 1051 may serve as a kind of idler to guide rotation of the flexible drum 40 while being rotated by the rotary force imparted on the flexible drum 1040 in connection with rotation of the driving rollers 1063*a* and 1063*b*.

In certain circumstances, the rolling part 1051 and the first and second driving rollers 1063*b* and 1063*a* may be separated away from each other, due to, for example, an extended use period of the dryer 1 or a number of times that the dryer 1 has been used. If the rolling part 1051 is separated from the first driving roller 1063*b* and the second driving roller 1063*a*, frictional force between the flexible drum 1040 and the driving rollers 1063*a* and 1063*b*, transmitting rotary force through direct friction with the flexible drum 1040, is reduced, thus increasing the potential for operational defects.

Thus, the dryer 1 as embodied and broadly described herein may also include a tensioner 1066, as shown in FIG. 5B, connecting the rolling part 1051 with a part of the inner space of the main body 10 so as to draw the rolling part 1051 toward the first driving roller 1063*b* and the second driving roller 1063*a*.

The tensioner 1066 may be, for example, a bar connecting the rolling part 1051 and the inner space of the main body 10, an elastic member that supplies an elastic force to the rolling part 1051 and the first and second driving rollers 1063*b* upon separation so as to restore the rolling part 1051 and the first and second driving rollers 1063*b* to original positions thereof, or other tensioning arrangement as appropriate.

The drum driving device 1060 shown in FIGS. 5A and 5B transmits a designated rotary force to the flexible drum 1040 by applying frictional force to a part of the outer circumferential surface of the flexible drum 1040. Alternatively, the drum driving device 1160 shown in FIG. 6 transmits designated rotary force to the flexible drum 1040 by applying greater frictional force to one of the front end and the rear end of the outer circumferential surface of the flexible drum 1040.

In more detail, the drum driving device 1160 shown in FIG. 6 may include a driving motor 1161A installed in the inner space of the main body 10, a driving pulley 1161 connected to a rotary shaft of the driving motor 1161A and rotated in connection with the driving motor 1161A, and a rotary belt 1164 having one end wound on the driving pulley 1161 and the other end wound on the outer circumferential surface of the flexible drum 1040 so as to transmit rotary force of the driving motor 1161A to the flexible drum 1040. Since the rotary belt 1164 is directly wound on the outer circumferential surface of the flexible drum 1040, the dryer 1 employing the drum driving device 1160 shown in FIG. 6 may more easily transmit a strong rotary force of the driving motor 1161A to the flexible drum 1040.

An anti-separation groove 1045 may be formed o the outer circumferential surface of the flexible drum 1040 to increase a friction surface between the rotary belt 1164 and the flexible drum 1040 and to prevent the rotary belt 1164 from being separated from the outer surface of the flexible drum 1040. The anti-separation groove 1045 may be formed integrally with the flexible drum 1040, or a separate part including the anti-separation groove 1045 may be manufactured separately from the flexible drum 1040 and then attached to the outer circumferential surface of the flexible drum 1040.

The driving motor 1161A may be installed at various positions in the inner space of the main body 10 as long as it does not interfere with rotation of the flexible drum 1040. In this exemplary embodiment, the driving motor 1161A is arranged at a position just below the front end or the rear end of the flexible drum 1040.

The drum driving device 1160 may include a tensioner 1166 to tightly pull the rotary belt 1164 so as to prevent the rotary belt 1164 inserted into the anti-separation groove 1045 from being loosened and then reducing frictional force. The tensioner 1166 may be a rotary roller arranged so as to directly support the rotary belt 1164. For example, as shown in FIG. 6, the rotary roller-type tensioner 1166 is arranged at one side of the driving pulley 1161, and supports the rotary belt 1164 in a direction of tightening the rotary belt 1164.

When the flexible drum 1040 is rotated by the drum driving device 1060 or 1160 in accordance with the embodiments shown in FIG. 5A-5B or 6, the rotation guides 1050 or 1150 guide efficient rotation of the flexible drum 1040 so as to enable laundry in the flexible drum 1040 to be uniformly tumbled.

Hereinafter, an operating process of the above-described dryer 1 in accordance with embodiments as broadly described herein will now be described in detail with reference to the accompanying drawings.

When a user operates the dryer 1, the drum driving device 1060 or 1160 is operated to transmit a designated rotary force to the flexible drum 1040. The flexible drum 1040 rotates in response to the rotary force transmitted thereto from the drum driving device 1060 or 1160, with the front end and the rear end of the flexible drum 1040 tightly supported by the rolling parts 1051 or 1151*a* and 1151*b* of the rotation guides 105 or 1150, respectively, thereby tumbling laundry placed in the flexible drum 1040. Since the flexible drum 1040 is made of a flexible material, as described above, the flexible drum 1040 may be rotatably supported by the rotation guides 1050 or 1150 while maintaining a designated non-circular cross-section.

With reference to FIGS. 7A and 7B and FIGS. 8A and 8B, rotation guides 2050 and 2150 in accordance with embodiments as broadly described herein are provided both to hook the front end or the rear end of the flexible drum 1040 and to guide rotation of the flexible drum 1040 while maintaining a rotating route of the flexible drum 1040. A plurality of rotation guides 2050 or 2150 may be arranged in the inner space at a plurality positions so as to support rotation of the flexible drum 1040 at the plurality of positions.

In more detail, each rotation guide 2050 or 2150 may include a hooking space 2051 or 2151 such that the front end or the rear end of the flexible drum 1040 is inserted and hooked into the hooking space 2051 or 2151 during rotation of the flexible drum 1040, and a contact part 2044 or contact part 2144*a* and 2144*b* installed at the front end or the rear end of the flexible drum 1040 and inserted and hooked into the hooking space 2051 or 2151 so as to move along the rotating route of the flexible drum 1040. The hooking space 2051 or 2151 may both receive the front end or the rear end of the flexible drum 1040 therein and guide rotation of the flexible drum 1040 during rotation of the flexible drum 1040.

The hooking space 2051 or 2151 may be manufactured as a part of the separate component that is then installed on the frame 1030, or may be formed integrally with the frame 1040. For example, the hooking space 2051 or 2151 may be formed between an outer hook terminal 2052*b* or 2152*b* arranged so as to cover a part of the outer surface of the front end or the rear end of the flexible drum 1040, and an inner hook terminal 2052*a* or 2152*a* arranged so as to cover a part of the inner surface of the front end or the rear end of the flexible drum 1040. A slit 2054 or 2154, through which the front end or the rear end of the flexible drum 1040 passes, is formed between the outer hook terminal 2052*b* or 2152*b* and the inner hook terminal 2052*a* or 2152*a*. The front end of the outer hook terminal 2052*b* or 2152*b* and the front end of the inner hook terminal 2052*a* or 2152*a* are extended toward the outer surface and the inner surface of the flexible drum 1040, respectively so that the contact part 2044 or the contact part 2144*a* and 2144*b* are hooked into the hooking space 2051 or 2151.

The contact part 2044 or the contact part 2144*a* and 2144*b* supports the part of the front end or the rear end of the flexible drum 1040 so as to facilitate rotation of the flexible drum 1040. The contact part 2044 or the contact part 2144*a* and 2144*b* is installed at the front end or the rear end of the flexible drum 1040, is inserted into the hooking space 2051 or 2151 together with the part of the front end or the rear end of the flexible drum 1040, and slides in a contact manner within the hooking space 2051 or 2151 during rotation of the flexible drum 1040, thereby guiding/supporting the rotation of the flexible drum 1040.

The contact part 2044 or the contact part 2144*a* and 2144*b* may also maintain the regular non-circular cross-section of the flexible drum 1040. That is, although the shape of the flexible drum 1040 may be minutely changed during rotation of the flexible drum 1040, the contact part 2044 or the contact part 2144*a* and 2144*b* is hooked into the hooking space 2051 or 2151 and maintains sliding contact, thereby maintaining the non-circular cross-section of the flexible drum 1040 while firmly guiding/supporting rotation of the flexible drum 1040.

Hereinafter, the rotation guides 2050 and 2150 and detailed configurations thereof will be described with reference to FIGS. 7A and 7B and FIGS. 8A and 8B.

Figure 7A:
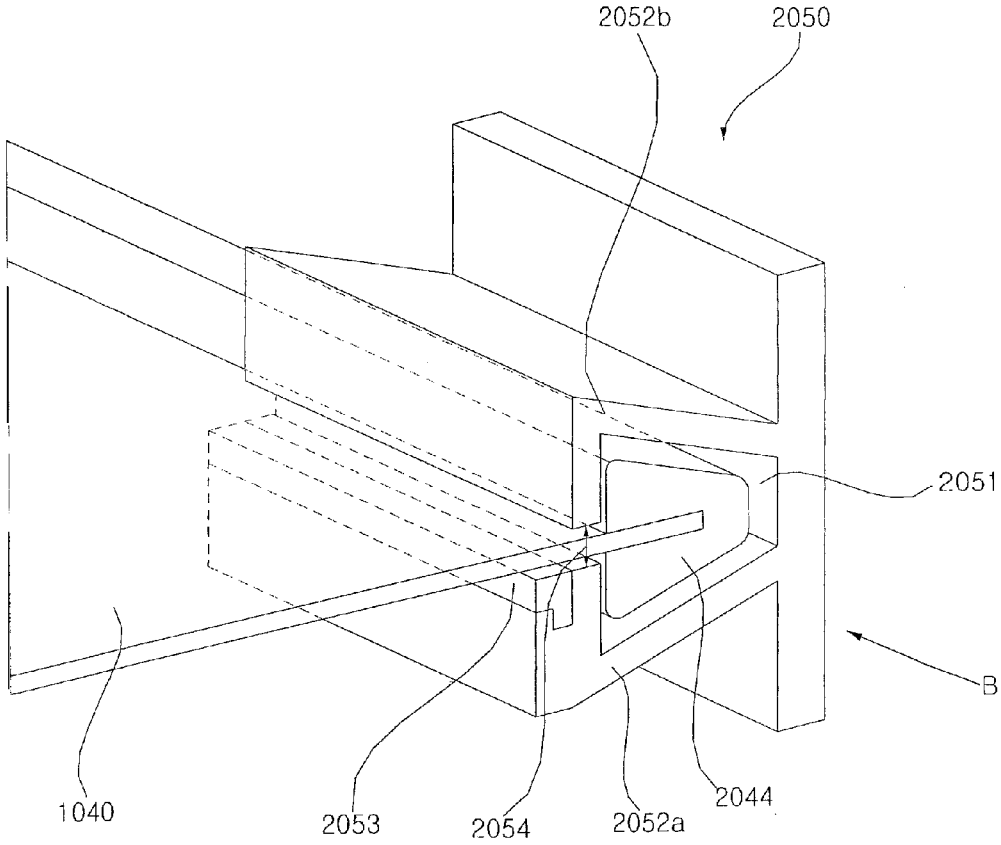
FIG. 7A illustrates a rotation guide in accordance with another embodiment as broadly described herein.
Figure 7B:
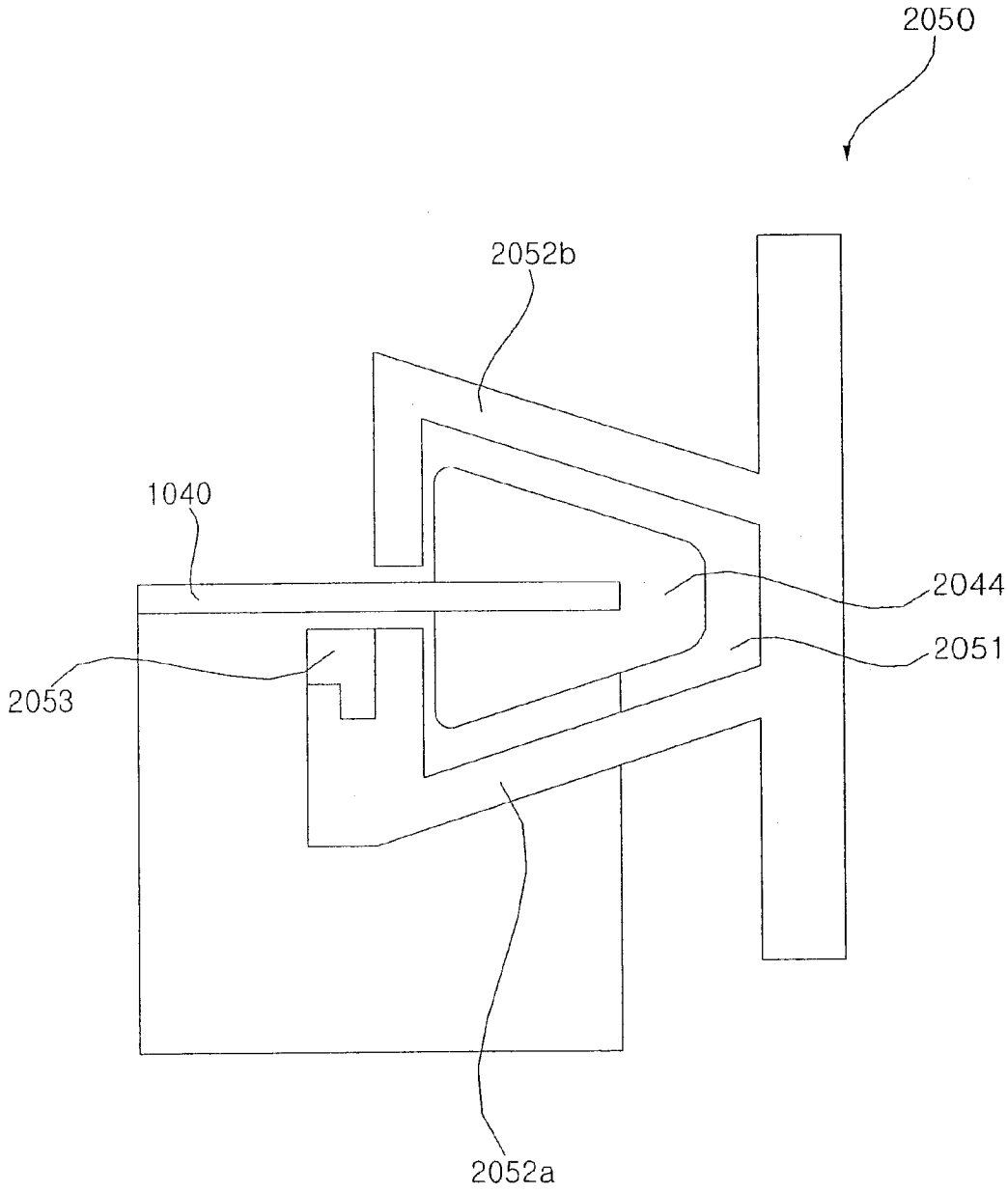
FIG. 7B is a front view of the rotation guide shown in FIG. 7A.

In the rotation guide 2050 shown in FIGS. 7A and 7B, the contact part 2044 is connected to a part of the front end or the rear end of the flexible drum 1040 and inserted into the hooking space 2051. The contact part 2044 has a cross-section corresponding to the cross-section of the hooking space 2051. A cross-sectional area of the contact part 2044 may be smaller than the cross-sectional area of the hooking space 2051. The thickness of the contact part 2044 may be greater than the width of the slit 2054, and may be sufficient to be caught in the hooking space formed by the outer hook terminal 2052*b* and the inner hook terminal 2052*a*.

The rotation guide 2050 of this embodiment may have a wedge-shaped cross section in which the width of the rotation guide 2050 is gradually decreased from the inside of the flexible drum 1040 to the outside of the flexible drum 1040, and the cross-section of the contact part 2044 may correspond to the cross-section of the hooking space 2051.

With the contact part 244 installed in the hooking space 2051, when the flexible drum 1040 is rotated, surfaces of the contact part 244 close to the outer hook terminal 2052*b* and the inner hook terminal 2052*a* respectively slide while contacting the inner surface of an extended part of the outer hook terminal 2052*b* and the inner surface of an extended part of the inner hook terminal 2052*a*. Therefore, the contact part 2044 contacting the outer hook terminal 2052*b* and the inner hook terminal 2052*a* may be made of a material having a low coefficient of friction. Further, even if the contact part 2044 is not made of a material having a low coefficient of friction, portions of the contact part 2044 contacting the outer hook terminal 2052*b* and the inner hook terminal 2052*a* may be coated with a friction reducing material, such as, for example, Teflon, so as to reduce frictional force.

As described above, the rotation guide 2050 in accordance with the embodiment shown in FIGS. 7A and 7B contacts and supports the flexible drum 1040, made of the flexible material, outwards, thereby guiding rotation of the flexible drum 1040 while maintaining the non-circular cross-section of the rotated flexible drum 1040. Further, in the rotation guide 2050 in accordance with the embodiment shown in FIGS. 7A and 7B, the contact part 2044 fixed to the front end or the rear end of the flexible drum 1040 is directly inserted into the hooking space 2051, thereby serving both to tightly pull the flexible drum 1040 forwards or rearwards and to prevent the flexible drum 1040 from being separated from the rotation guide 2050 forwards or rearwards.

The hooking space 2051, in which the contact part 2044 is installed, covers the contact part 2044 from the outside except for the slit 2054 formed between the outer hook terminal 2052*b* and the inner hook terminal 2052*a*. Particularly, the inner hook terminal 2052*a* and the inner surface of the flexible drum 1040 may be close to each other to prevent tumbling laundry from being caught in the hooking space 2051, or small foreign substances or lint from being caught in the hooking space 2051.

Since the flexible drum 1040 is configured so as to be efficiently rotated, a tolerance of a certain degree between one end of the inner hook terminal 2052*a* and the flexible drum 1040 may be generated, while a gap formed between the inner hook terminal 2052*a* and the flexible drum 1040 may be as small as possible so as not to disturb the function of the rotation guide 2050. Thus, a sealer 2053 may be provided on the rotation guide 2050 between the flexible drum 1040 and the inner hook terminal 2052*a*. The sealer 2053 may be inserted onto the extended part of the inner hook terminal 2052*a*, i.e., the front end of the inner hook terminal 2052*a* to fill the gap between the flexible drum 1040 and the inner hook terminal 2052*a* without affecting rotation of the flexible drum 1040 due to friction between the sealer 2053 and the flexible drum 1040 even if the flexible drum 1040 is rotated and contacts the sealer 2053. Therefore, the sealer 2053 may be made of a material having a low coefficient of friction. For example, the sealer 2053 may be made of fabric or rubber having a low coefficient of friction. Alternatively, the sealer 2053 may include a brush type arrangement provided at the end of the inner hook terminal 2052*a* forming the hooking space. Other sealing mechanisms may also be appropriate.

Figure 8A:
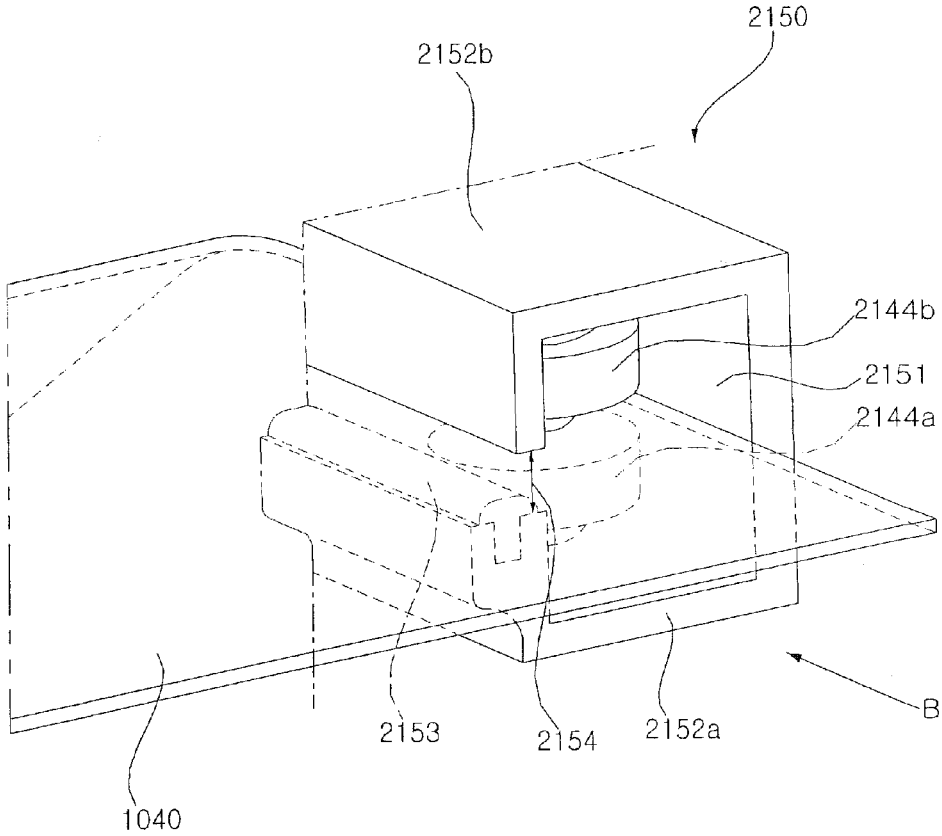
FIG. 8A illustrates a rotation guide in accordance with another embodiment as broadly described herein.
Figure 8B:
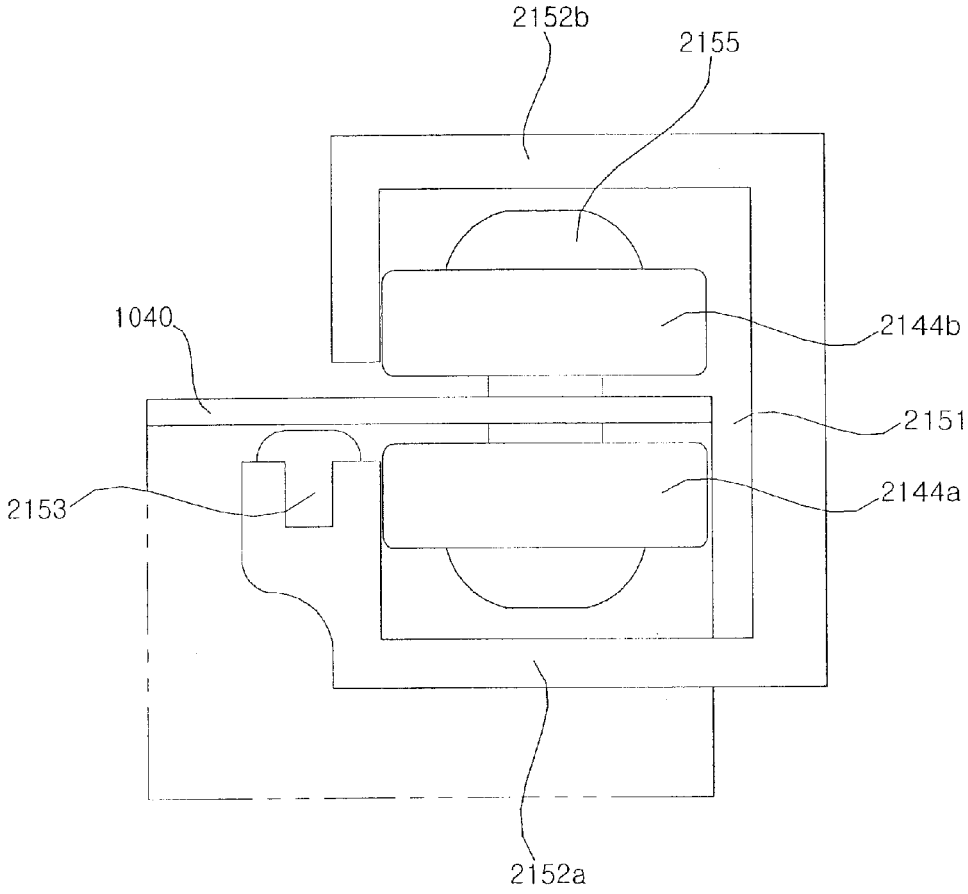
FIG. 8B is a front view of the rotation guide shown in FIG. 8A.

In the rotation guide 2150 in accordance with the embodiment shown in FIGS. 8A and 8B, the contact part includes a first roller 2144*b* rotatably installed on a rotary shaft 2155 passing through the front end or the rear end of the flexible drum 1040 so as to rotate in the hooking space 2151 while contacting the outer hook terminal 2152*b*, and a second roller 2144*a* installed on the rotary shaft 2155 so as to rotate in the hooking space 2151 while contacting the inner hook terminal 2152*a*. In the rotation guide 2150 shown in FIGS. 8A and 8B, the first roller 2144*b* and the second roller 2144*a* of the contact part contact the outer hook terminal 2152*b* and the inner hook terminal 2152*a* in the hooking space 2151 as they rotate, thereby preventing rotary force loss due to frictional force during rotation of the flexible drum 1040.

In order to prevent laundry, small foreign substances or lint from being caught in the hooking space 2151 through a gap between the inner hook terminal 2152*a* and the inner surface of the flexible drum 1040, a sealer 2153 may be arranged at the inner hook terminal 2152*a* similar to the embodiment shown in FIGS. 7A and 7B.

The rotation guides 2050 or 2150 may be arranged at a plurality of positions along the front end and the rear end of the frame 1030 and the flexible drum 1040. The contact parts 2044 in accordance with the embodiment shown in FIGS. 7A and 7B and the first rollers 2144*b* and the second rollers 2144*a* in accordance with the embodiment shown in FIGS. 8A and 8B may be arranged at a plurality of positions along the front end and the rear end of the flexible drum 1040, while the hooking spaces 2051 or 2151 may be formed throughout the rear end and the front end of the frame 130 corresponding to the whole of a designated rotating route of the flexible drum 1040 so as to guide rotation of the contact part 2044 and rotation of the first roller 2144*b* and the second roller 2144*a* during rotation of the flexible drum 1040 along the rotating route.

Hereinafter, an operating process of the above-described dryer 1 in accordance with embodiments will be described in detail with reference to the accompanying drawings.

When a user operates the dryer 1, the drum driving device 1060 or 1160 is operated to transmit a designated rotary force to the flexible drum 1040. The rotation guides 2050 or 2150 arranged at the front end and the rear end of the flexible drum 1040 with the contact parts 2044 or 2144*a* and 2144*b* inserted/hooked into the corresponding hooking spaces 2050 and 2151, the flexible drum 1040, receiving the rotary force from the drum driving device 1060 or 1160, may be tightly supported during rotation. Since the flexible drum 1040 is made of a flexible material, as described above, the flexible drum 1040 may be rotatably supported by the rotation guides 2050 or 2150 while maintaining a designated non-circular cross-section.

With reference to FIGS. 9-12, a dryer 1 in accordance with another embodiment as broadly described herein may include a flexible drum 3040 rotatably installed on a frame 3030. Some of the characteristics of the flexible drum 3040 are similar to those of the flexible drum 1040 shown in FIG. 2, and thus a detailed description thereof will be omitted and only parts thereof which are different from those of the flexible drum 1040 of FIG. 2 will be described below.

With reference to FIGS. 9 to 12, the flexible drum 3040 in accordance with this embodiment includes geared protrusions 3043 formed along the edges of the outer surfaces of the front end and the rear end of the flexible drum 3040 protruding outward by a designated length, rigid members 3041, lifters 3042 and engagement gears 3063 positioned so as to engage the geared protrusions 3043. In this embodiment, rotation guides 3050 may be fixed to the frame 3030 at a plurality of positions. A detailed configuration of the rotation guide 3050 is substantially the same as that of the rotation guides described above.

Figure 12A:
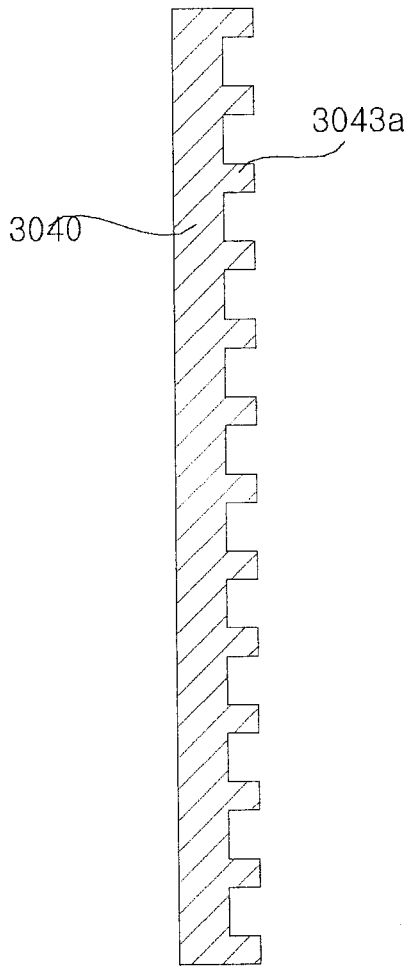
FIG. 12A is a partial cross-sectional view of a flexible drum with geared protrusions in accordance with another embodiment as broadly described herein.
Figure 12B:
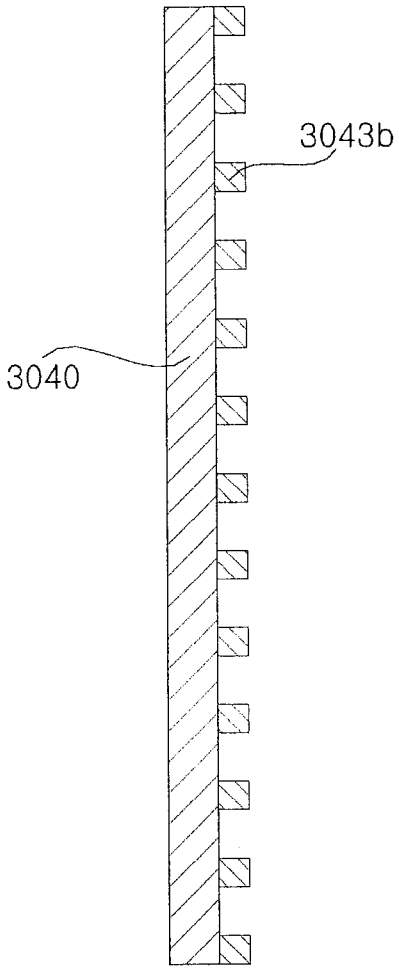
FIG. 12B is a partial cross-sectional view of a flexible drum with geared protrusions in accordance with another embodiment as broadly described herein.
Figure 12C:
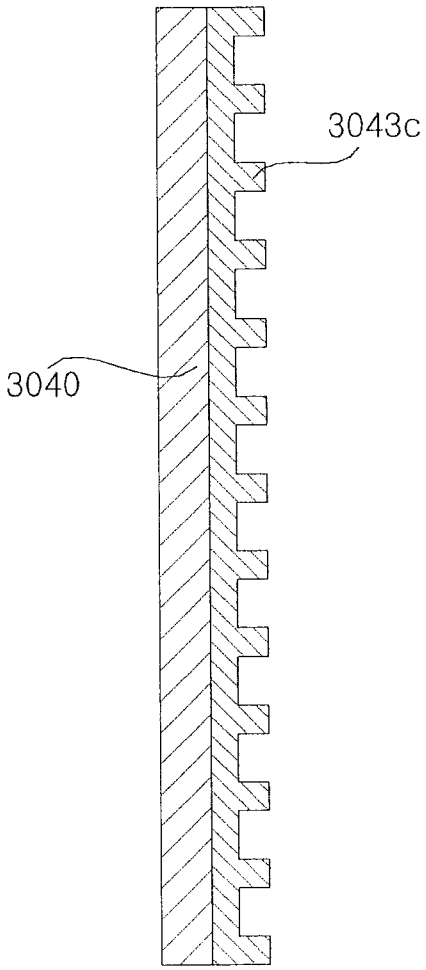
FIG. 12C is a partial cross-sectional view of a flexible drum with geared protrusions in accordance with another embodiment as broadly described herein.

The geared protrusions 3043, may be protrusions 3043*a* that are formed integrally with the flexible drum 3040 when the flexible drum 3040 is molded, as shown in FIG. 12A, may be protrusions 3043*b* that are manufactured separately from the flexible drum 3040 and be attached to the outer surface of the molded flexible drum 3040, as shown in FIG. 12B, or may be protrusions 3043*c* that are molded in a geared protrusion type pad separately from the flexible drum 3040 so as to be easily connected to the flexible drum 3040, as shown in FIG. 12C.

Figure 9:
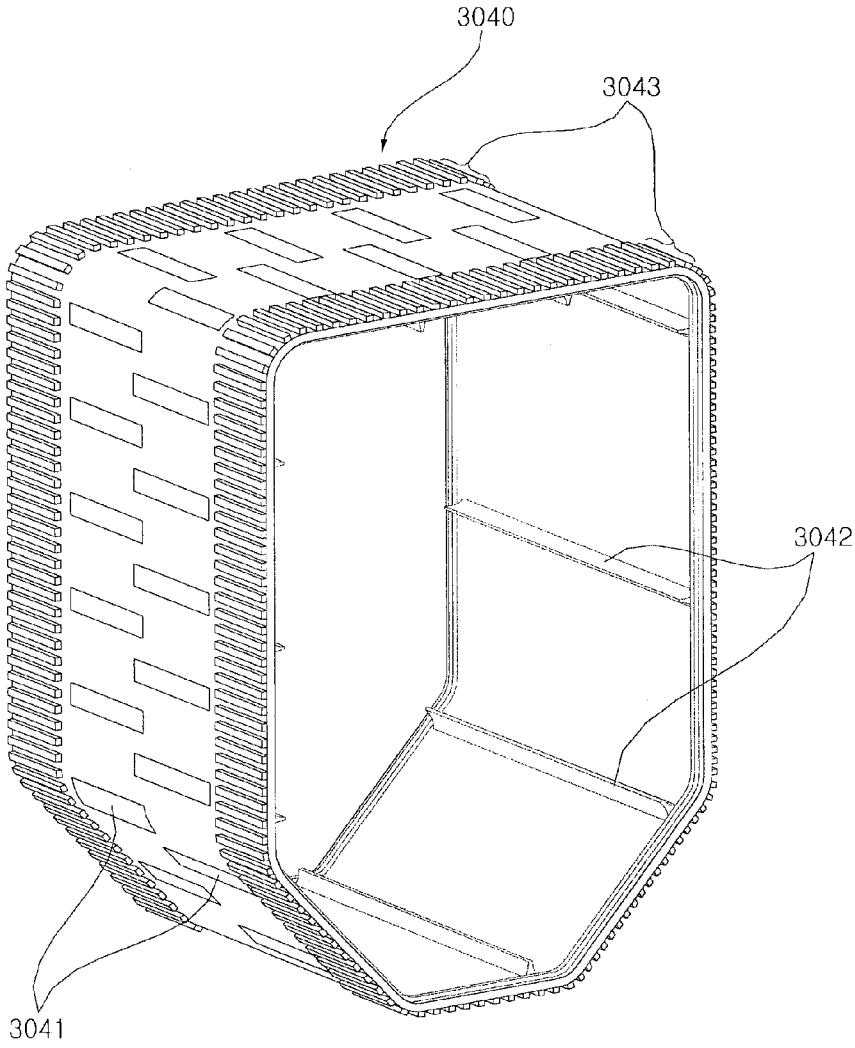
FIG. 9 illustrates a flexible drum in accordance with another embodiment as broadly described herein.

As shown in FIG. 9, the geared protrusions 3043 may be formed along the edges of the outer surfaces of the front end and the rear end of the flexible drum 3040. However, arrangement of the geared protrusions 3043 is not limited thereto, and other arrangements may also be appropriate. That is, in alternative embodiments the geared protrusions 3043 may instead be formed throughout the outer surface of the flexible drum 3040. In such an alternative embodiment, two engagement gears 3063 may not be required. Rather, if another component (for example, a support part installed so as not to interfere with the inside of the flexible drum 3040 during tumbling of laundry) to assure sufficient supporting force to engage the engagement gear 3063 with the geared protrusions 3043 were provided on the inner surface of the flexible drum 3040, only one engagement gear 3063 may be provided at the center of the outer surface of the flexible drum 3040, thereby achieving a reduction in cost and complexity.

The geared protrusions 3063 are engaged with the engagement gears 3063 of a drum driving device 3060, which will be described later, so as to transmit a rotary force of a driving motor to the flexible drum 3040 during operation of the driving motor.

Figure 10:
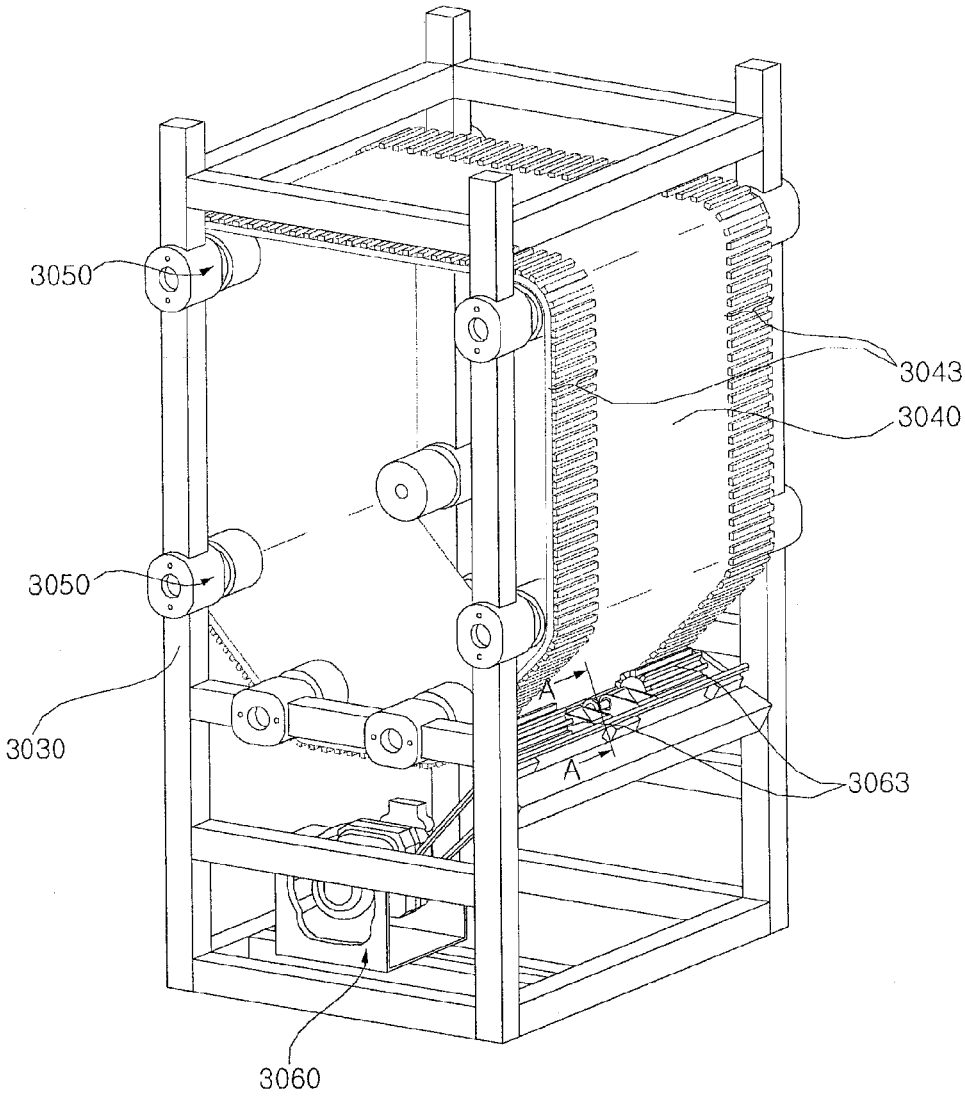
FIG. 10 is a perspective view of an internal structure of a dryer in accordance with an embodiment as broadly described herein.
Figure 11:
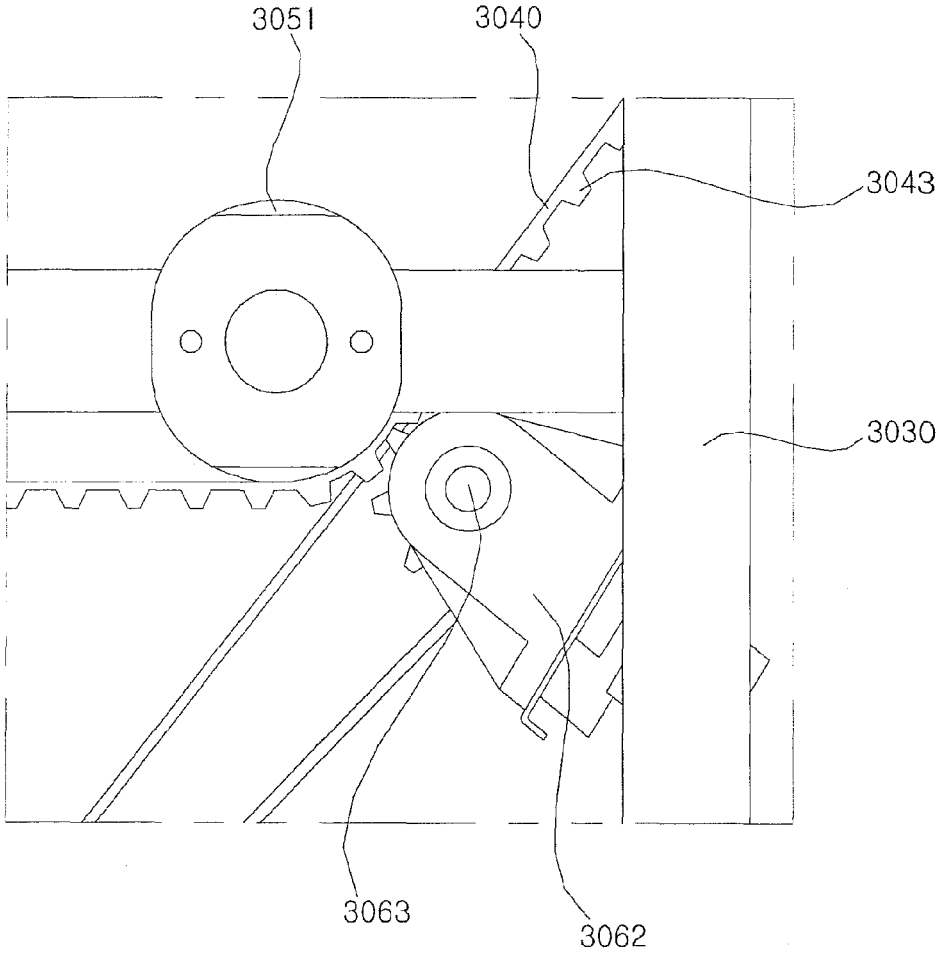
FIG. 11 is a cross-sectional view taken along line A-A of FIG. 10.

With reference to FIGS. 10 to 11, the drum driving device 3060 may be installed in the inner space of the main body 10 to rotate the flexible drum 3040. The drum driving device 3060 may include a driving motor installed in the inner space of the main body 10, and the engagement gears 3063 may be rotated in connection with rotation of a rotary shaft of the driving motor and engaged with the geared protrusions 3043. The engagement gears 3063 may be rotatably connected to brackets 3062. The driving motor may be fixedly installed in the inner space corresponding to the outside of the flexible drum 3040.

In the driving device 3060, a driving pulley on which a rotary belt is wound may be arranged on the rotary shaft of the driving motor, a driven pulley on which the rotary belt is wound may be arranged on a rotary shaft of the engagement gears 3063, and the driving pulley and the driven pulley may be connected by the rotary belt. The engagement gears 3063 may be engaged with the geared protrusions 3043 formed on the outer surface of the flexible drum 3040. Therefore, when the driving motor is rotated, the rotary belt wound on the driving pulley is rotated to transmit rotary force of the driving motor to the driven pulley, and the driven pulley rotates the engagement gears 3063 using the same rotary shaft. Then, the engagement gears 3063 are engaged with the geared protrusions 3043, thus rotating the flexible drum 3040.

If the geared protrusions 3043 are respectively formed at both sides, i.e., the front end and the rear end, of the outer surface of the flexible drum 3040, as shown in FIG. 10, the engagement gears 3063, having a length corresponding to the length of the geared protrusions 3043 in the width direction of the flexible drum 3040, may be arranged at both sides of the rotary shaft on which the driven pulley is arranged.

Since the flexible drum 3040 is made of a flexible material, as described above, if external force is transmitted to the flexible drum 3040 when the engagement gears 3063 are engaged with the geared protrusions 3043, the shape of the flexible drum 3040 may be changed in terms of characteristics of the material thereof, and thus a mismatch may be caused during the engaging process.

In order to prevent such a mismatch during the engaging process of the engagement gears 3063 with the geared protrusions 3043, as shown in FIG. 11, the engagement gear 3063 may be arranged at a position rotatably supported by a rolling part 3051 of the rotation guide 3050 when the flexible drum 30 40 is located between the engagement gear 3063 and the rolling part 3051, so as to be engaged with the geared protrusions 3043. In this instance, the rolling part 3051 serves as a kind of idler, which is rotated in connection with the flexible drum 3040 and guides rotation of the flexible drum 3040. A configuration of the rolling part 3051 is substantially the same as that of the rotation guide 1050 described with reference to FIGS. 3A and 3B, and thus only parts thereof which are different from those of the rotation guide 1050 will be described below.

The rolling part 3051 serves to support a part of the front end or the rear end of the inner surface of the flexible drum 3040 so as to facilitate rotation of the flexible drum 3040. The rolling part 3051 is rotated about a rotary shaft fixed to the main body 10 or the frame 1030, and guides/supports rotation of the flexible drum 3040 through contact of the outer circumferential surface of the rotated rolling part 3051 with the front end or the rear end of the flexible drum 1040. The rolling part 3051 also serves to maintain a regular polygonal cross-section of the flexible drum 3040 as well as to guide/support rotation of the flexible drum 3040. That is, although the shape of the flexible drum 3040 may be minutely changed during rotation of the flexible drum 3040, the rolling parts 3051 maintain the polygonal cross-sectional-shape while firmly guiding/supporting rotation of the flexible drum 3040.

The rolling part 3051 and the engagement gear 3063 may become separated from each other due to, for example, extended use of the dryer 1 or the number of times that the dryer 1 has been used. Therefore, the dryer 1 may also include a tensioner connecting the rolling part 3051 and a part of the inner space of the main body 10 to urge the rolling part 3051 toward the engagement gear 3063. The tensioner may be, for example, a bar connecting the rolling part 3051 and the inner space of the main body 10, or an elastic member that supplies an elastic force to the rolling part 3051 and the engagement gear 3063 when the rolling part 3051 and the engagement gear 3063 are separated from each other, so as to restore the rolling part 3051 and the engagement gear 3063 to original positions thereof.

Hereinafter, an operating process of the above-described dryer 1 in accordance with this embodiment will be described in detail with reference to the accompanying drawings.

When a user operates the dryer 1, the drum driving device 3060 is operated to transmit a designated rotary force to the flexible drum 3040. The flexible drum 3040 receiving the rotary force transmitted from the drum driving device 3060 is rotated, with the front end and the rear end of the flexible drum 3040 tightly supported by the rolling parts 3051 of the rotation guides 3050, respectively, thereby tumbling laundry placed in the flexible drum 3040. Since the flexible drum 3040 is made of a flexible material, as described above, the flexible drum 3040 is rotatably supported by the rotation guides 3050 while maintaining a designated non-circular cross-section. The engagement gears 3063 of the drum driving device 3060 obtain effective frictional force while being rotatably supported by the rolling parts 3051 supporting the flexible drum 3040 in an outward direction. Thereafter, the engagement gears 3063 are engaged with the geared protrusions 3043 formed on the outer surface of the flexible drum 3040, and are rotated, thereby rotating the flexible drum 3040.

Figure 13:
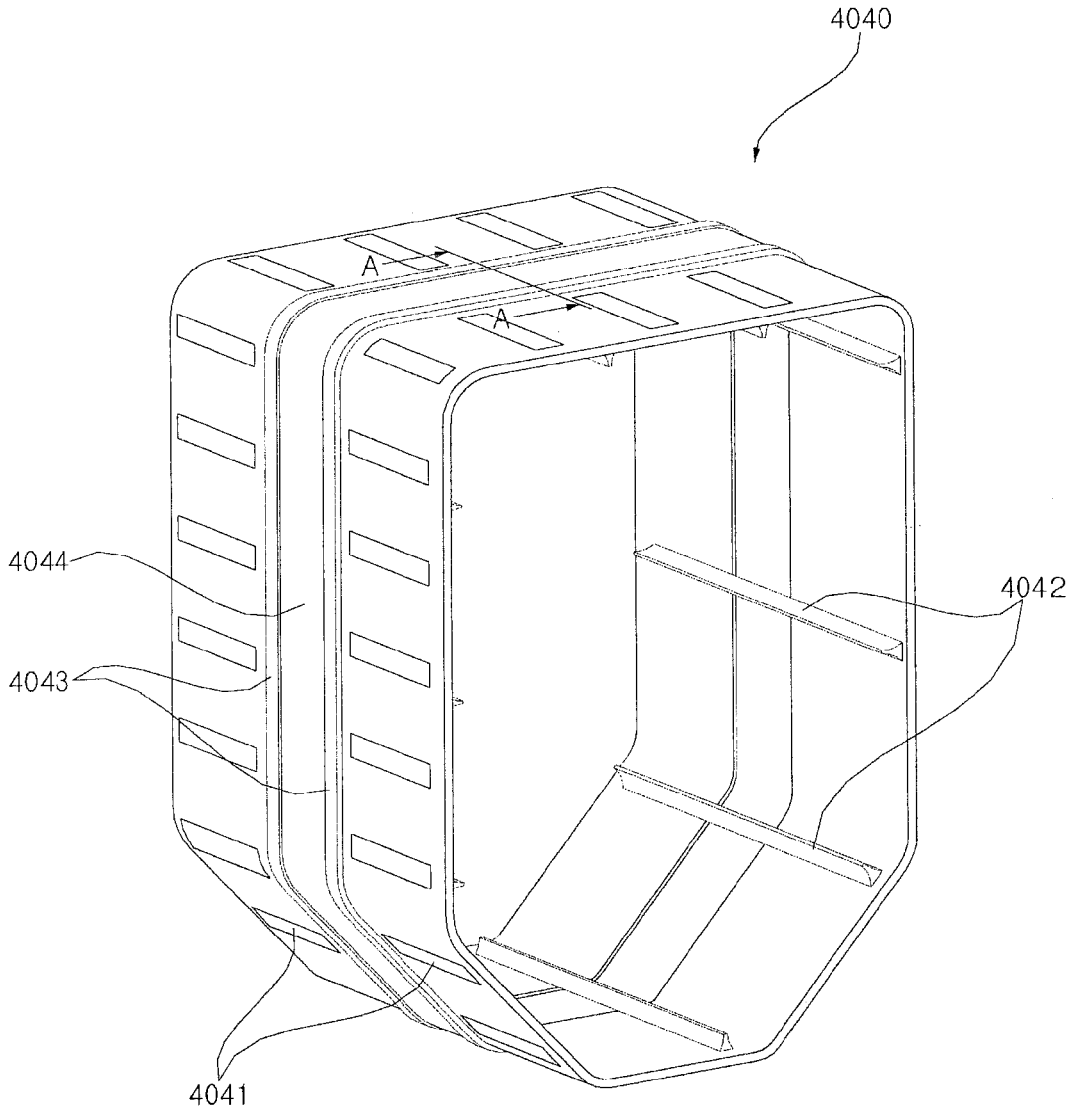
FIG. 13 is a perspective view of a flexible drum in accordance with another embodiment as broadly described herein.

With reference to FIG. 13, a flexible drum 4040 in accordance with another embodiment as broadly described herein may include rigid members 4041 and lifters 4042. In the drawings from FIGS. 13 to 17, configurations or functions of parts of the flexible drum 4040 may be substantially the same as those of the flexible drum 1040 in the embodiment of FIG. 2 except for rotation guides 4050, and thus a detailed description thereof will be omitted and only parts thereof which are different from those of the flexible drum 1040 will be described below.

Since the flexible drum 4040 is made of a flexible material, which may be deformed due to rotation, deformation of the material for the flexible drum 4040 during rotation is possible, thus impacting durability of the flexible drum 4040. In order to solve this problem, a dryer 1 in accordance with this embodiment includes the rigid members 4041 attached to the outer surface of the flexible drum 4040 such that the rigid members 4041 do not disturb rotation of the flexible drum 4040. The rigid members 4041 may be made of any material having greater rigidity than the material of the flexible drum 4040. For example, the rigid members 4041 may be, for example, relatively thin steel plates or rubber plates having excellent elasticity. A plurality of rigid members 4041 may be arranged on the outer surface of the flexible drum 4040, i.e., arranged in a first line on the outer surface of the front portion of the flexible drum 4040 and in a second line on the outer surface of the rear portion of the flexible drum 4040.

A drum driving device 4060 may be installed in the inner space of the main body to rotate the flexible drum 4040. The drum driving device 4060 may include a driving motor 4061 installed in the inner space of the main body 10, a driving pulley 4062 connected to a rotary shaft of the driving motor 4061 and rotated in connection with the driving motor 4061, and a rotary belt 4064 provided with one end wound on the driving pulley 4062 and the other end wound on the outer circumferential surface of the flexible drum 4040 and rotated to transmit rotary force of the driving motor 4061 to the flexible drum 4040. Since the rotary belt 4064 is directly wound on the outer circumferential surface of the flexible drum 4040, the dryer 1 employing the drum driving device 4060 shown in FIG. 14 may more easily transmit a strong rotary force of the driving motor 4061 to the flexible drum 4040.

Figure 14:
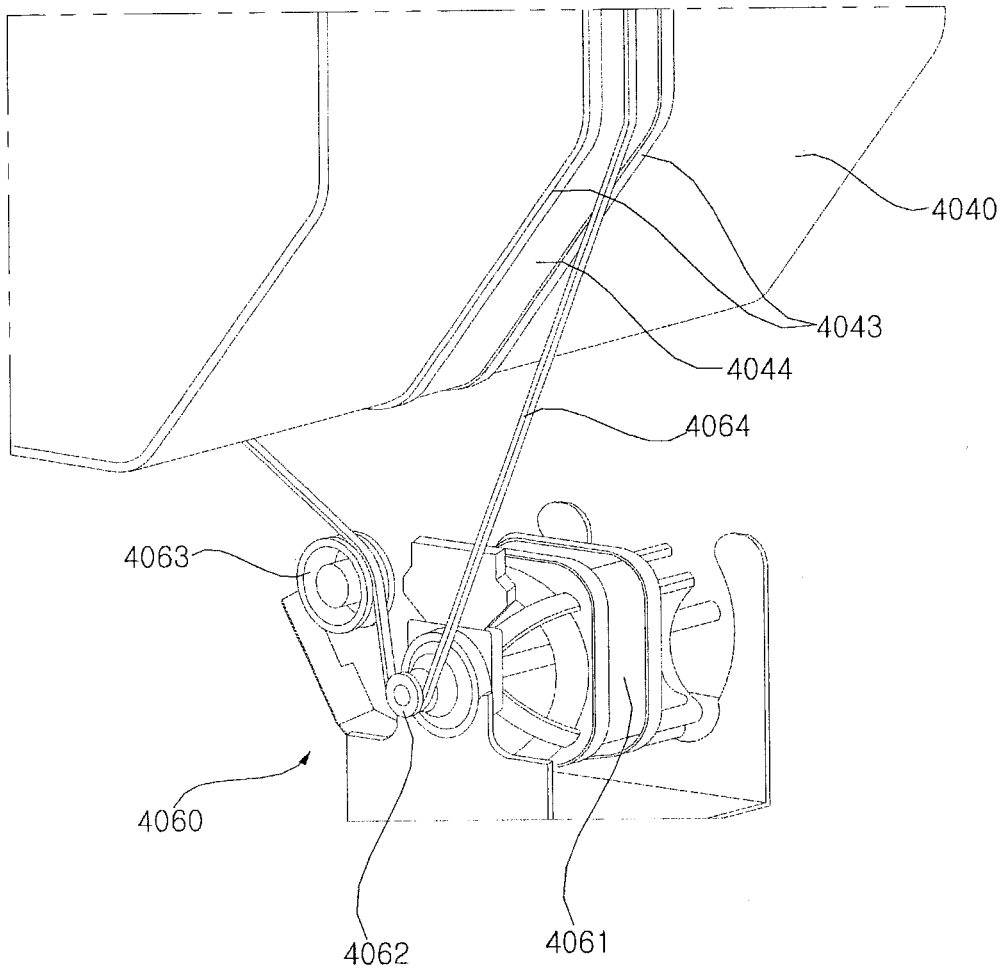
FIG. 14 is a perspective view of a drum driving device in accordance with an embodiment as broadly described herein.
Figure 15:
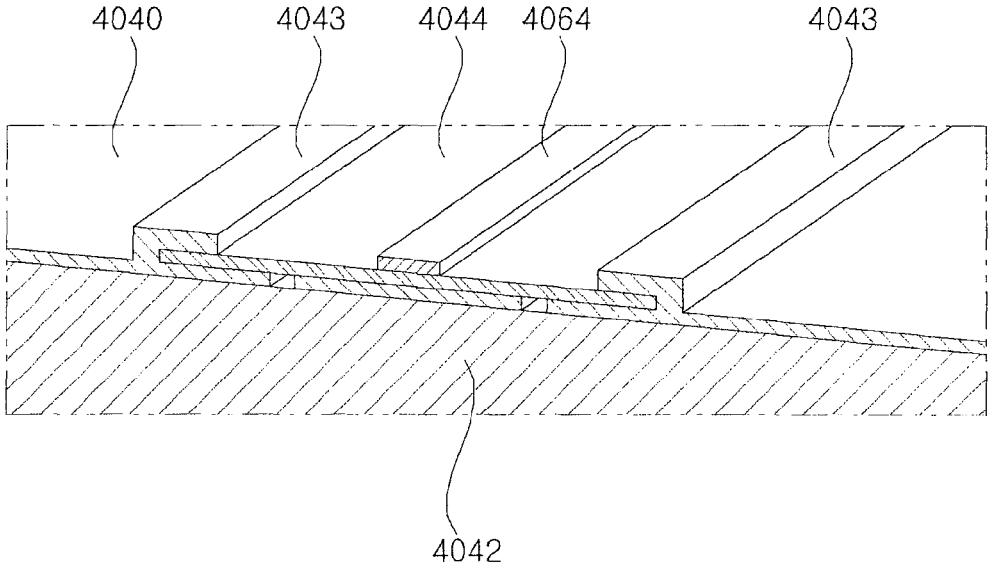
FIG. 15 is a cross-sectional view taken along line A-A of FIG. 13.

With reference to FIGS. 13 to 15, a friction panel 4044 to increase frictional force on a friction surface between the rotary belt 4064 and the flexible drum 4040 may be arranged on the outer circumferential surface of the flexible drum 4040. The friction panel 4044 may be arranged along the center of the outer circumferential surface of the flexible drum 4040, for example, between the first and second lines of rigid members 4041.

In order to facilitate connection of the flexible drum 4040 to both sides of the friction panel 4044, a pair of connection parts 4043 may be arranged at both sides of the friction panel 4044. The friction panel 4044 may be located between the pair of connection parts 4043 and may be connected to the pair of connection parts 4043. A groove may be formed on each of the connection parts 4043, and the friction panel 4044 may be connected to the connection parts 4043 by inserting both side ends of the friction panel 4044 into the grooves of the connection parts 4043. Alternatively, the friction panel 4044 may be connected to the connection parts 4043 by fusion or using fastening members, such as screws.

Since the friction panel 4044 directly rubs against the rotary belt 4064 and serves to increase rotary force of the flexible drum 4040, the friction panel 4044 may be made of a material having a relatively high frictional force with the rotary belt 4064.

Although the driving motor 4061 of FIG. 14 may be installed at any position in the inner space of the main body 10, the driving motor 4061 is installed at a position which does not interfere with rotation of the flexible drum 4040. Further, in this embodiment, since the rotary belt 4064 is wound on the friction panel 4044 arranged at the center of the flexible drum 4040, the driving motor 4061 may be arranged just below the flexible drum 4040. Hereinafter, on the assumption that the driving motor 4061 is arranged just below the flexible drum 4040, the drum driving device 4060 will be described.

With reference to FIG. 14, the drum driving device 4060 may also include a tension pulley 4063 to tightly pull the rotary belt 4064 so as to prevent frictional force loss due to loosening of the rotary belt 4064. The tension pulley 4063 may be arranged on a rotating route of the rotary belt 4064 so as to directly support the rotary belt 4064. For example, as shown in FIG. 14, the tension pulley 4063 may be arranged at one side of the driving pulley 4062 so as to support the rotary belt 4064 and urge it in a direction of tightening the rotary belt 4064.

The flexible drum 4040 may be rotated by the drum driving device 4060 in such a manner, thereby uniformly tumbling laundry in the flexible drum 4040. Wet laundry in the flexible drum 4040 may be effectively tumbled so as to be rapidly dried using hot air. Thus, in addition to friction between the inner surface of the flexible drum 1040 and the laundry, the flexible drum 4040 may also include lifters 4042 extending from the front end to the back end of the inner surface of the flexible drum 4040 and protruding into the drum 4040 by a designated length. The lifters 4042 may be fused to the inner surface of the flexible drum 4040, or be connected to the inner surface of the flexible drum 4040 by fastening members, such as screws, or other mechanism as appropriate.

Figure 16:
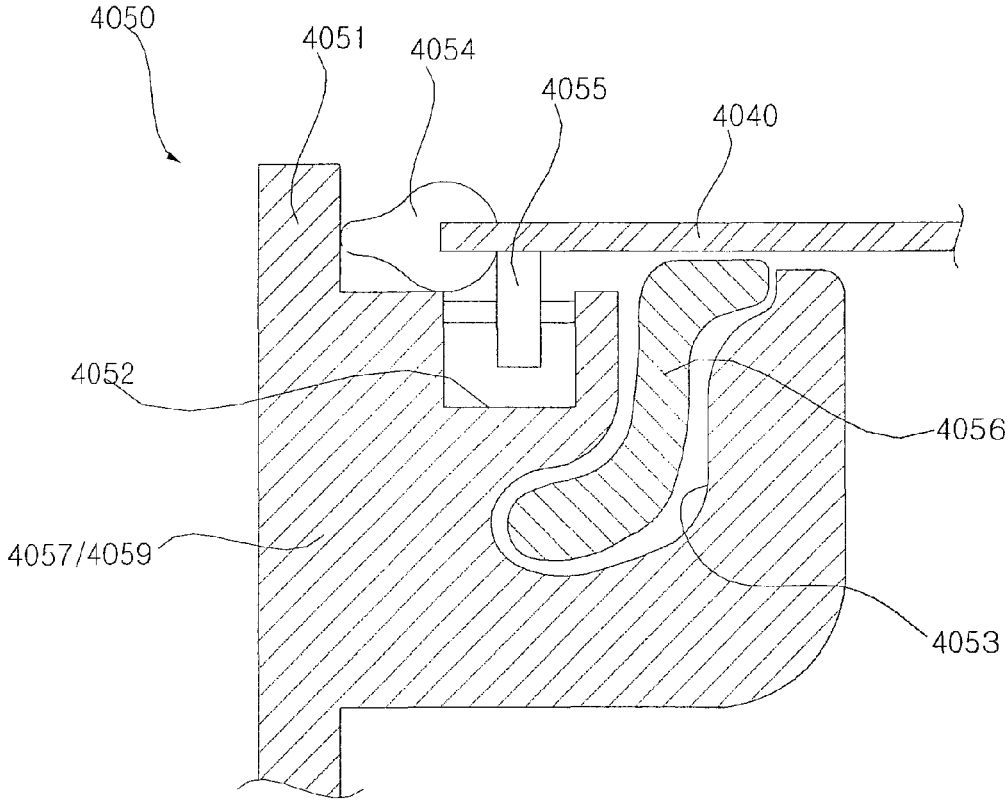
FIG. 16 is a cross-sectional view taken along line B-B of FIG. 1B.
Figure 17:
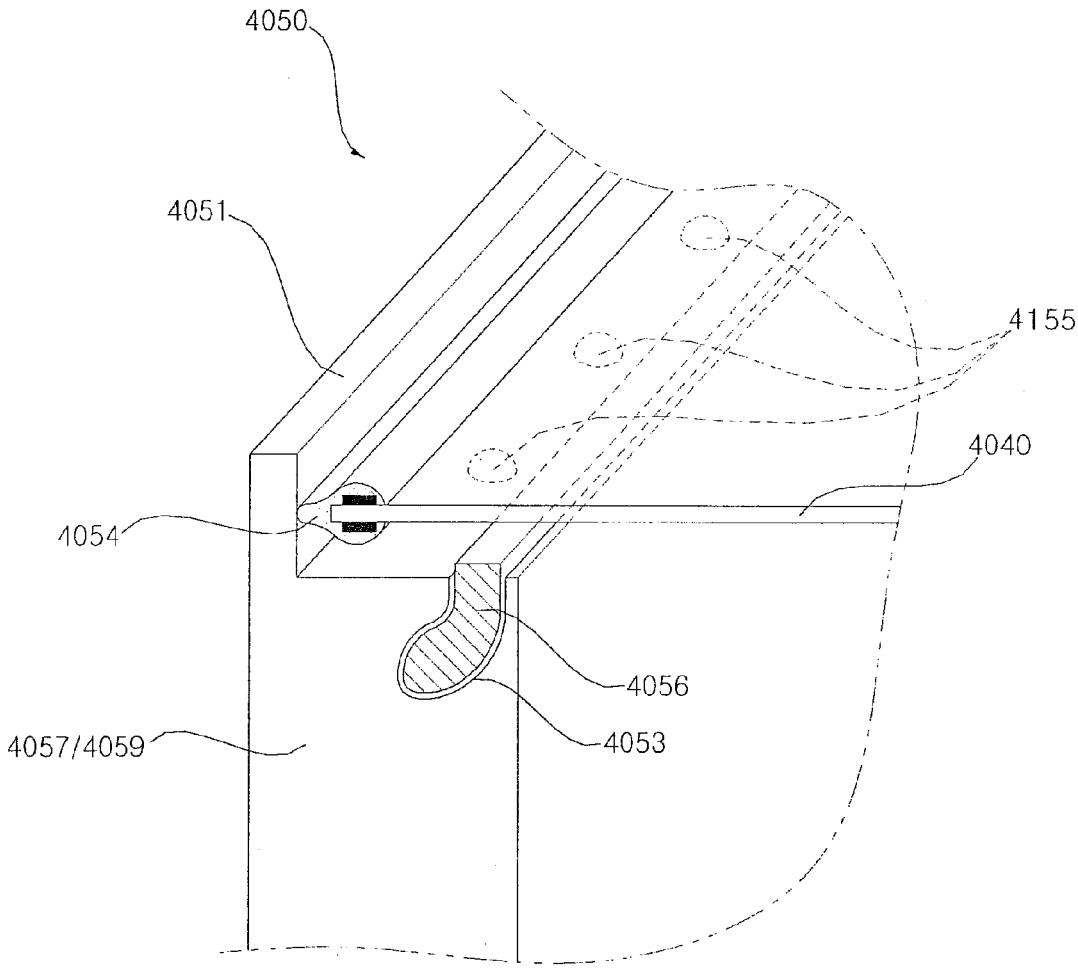
FIG. 17 is a perspective view of a rotation guide of FIG. 16 in accordance with another embodiment as broadly described herein.

With reference to FIGS. 16 and 17, a rotation guide 4050 in accordance with this embodiment guides rotation of the flexible drum 4040 installed in the inner space of the main body 10 so that the flexible drum 4040 is rotated while maintaining a rotating route of the flexible drum 4040 having a non-circular cross-section. Such a rotation guide 4050 may be arranged on each of the front end and the rear end of the flexible drum 4040 in a direction of supporting each of the front end and rear end toward the center of the outer circumferential surface of the flexible drum 4040. The rotation guides 4050 may be arranged along the edges of the cover panels 4057 and 4059 covering the front and rear open faces of the flexible drum 4040. A circular opening through which laundry may be loaded into and removed from the flexible drum 4040 may be formed through the cover panel 4059 corresponding to the front opening.

The rotation guide 4050, as shown in FIG. 16, includes a contact terminal 4051 contacting and supporting the front end or the rear end of the flexible drum 4040, and a rotary roller device rotatably supporting the inner surface of the front end or the rear end of the flexible drum 4040. The rotary roller device may include an installation part 4052 formed as a recess or depression near the edge of the cover panel 4057 or 4059, and a plurality of support rollers 4055 rotatably installed in the installation part 4052. The installation part 4052 may be formed integrally with the cover panel 4057 or 4059 so as to form a closed curve along the edge of the cover panel 4057 or 4059, and the plurality of support rollers 4055 may be arranged in the installation part 4052 so as to be separated from each other by a designated interval.

The rotation guide 4050 may also include a drum sealer 4054 inserted onto the front end or the rear end of the flexible drum 4040 so as to be supported forwards or rearwards by the contact terminal 4051. A size of the contact terminal 4051 of the rotation guide 4050 may be greater than that of the edge of the flexible drum 4040 so as to support the drum sealer 4054 forwards or rearwards. The drum sealers 4054 are supported by the contact terminals 4051 of the cover panels 4057 and 4059 such that eccentricity of the flexible drum 4040 in one direction, i.e., in the forward direction or in the rearward direction, may be prevented. Further, the drum sealers 4054 may hermetically seal gaps between the cover panels 4057 and 4059 and the flexible drum 4040, thereby preventing foreign substances from being introduced into the flexible drum 4040 and foreign substances, generated from the inside of the flexible drum 4040, from being discharged to the outside. Since the drum sealers 4054 facilitate rotation of the flexible drum 4040, the drum sealers 4054 may be made of a material having a low coefficient of friction, such as, for example, fabric, rubber having a low coefficient of friction, or a polymer compound having a low coefficient of friction.

Hereinafter, a process of guiding rotation of the flexible drum 4040 through the rotation guides 4050 during rotation of the flexible drum 4040 will be described.

First, when the flexible drum 4040 is rotated, the plural support rollers 4055 installed along the installation part 4052 support the flexible drum 4040 outwards, thereby facilitating rotation of the flexible drum 4040. If the flexible drum 4040 is eccentric in any one direction, i.e., in the forward direction or in the rearward direction, during rotation of the flexible drum 4040, the drum sealers 4054 are supported by the contact terminals 4051 of the cover panels 4057 and 4059, and thus the flexible drum 4040 is easily rotated and the eccentricity accommodated/corrected. Further, as shown in FIG. 16, in the rotation guides 4050, sealers 4056 are respectively provided on the cover panels 4057 and 4059 so as to prevent foreign substances or lint from being discharged to the outside.

One end of the sealer 4056 may be inserted into an insertion hole 4053 formed in the cover panel 4057 or 4059, and the other end of the sealer 4056 may protrude toward the inner surface of the flexible drum 4040. The sealer 4056 may fill the gap between the flexible drum 4040 and the cover panel 4057 or 4059 without affecting rotation of the flexible drum 4040 due to friction between the sealer 4056 and the flexible drum 4040 even if the flexible drum 4040 is rotated and thus contacts the sealer 4056. Therefore, the sealers 4056 may be made of a material having a low coefficient of friction, such as, for example, fabric or rubber having a low coefficient of friction. Further, the sealer 4056 may employ a brush type arrangement at one end of the installation part 4052. The sealers 4056 hermetically seal the gaps between the inner surface of the flexible drum 4040 and the cover panels 4057 and 4059. In order to prevent the hermetically sealed state of the gaps from being released due to vibration generated during rotation of the flexible drum 4040, the drum sealers 4056 also hermetically seal the gaps between the cover panels 4057 and 4059 and the front and rear end of the flexible drum 4040. Therefore, the gaps between the inner surface of the flexible drum 4040 and the cover panels 4057 and 4059 are hermetically double-sealed by the sealers 4056 and the drum sealers 4054.

However, parts of the rotation guides 4040 to support rotation of the flexible drum 4040 are not limited to the support rollers 4055 shown in FIG. 16. For example, with reference to FIG. 17, instead of the support rollers 4055, a plurality ball bearings 4155 to support the inner surface of the rotated flexible drum 4040 may be provided on the cover panels 4057 and 4059. The plurality of ball bearings 4155 may be arranged so as to be separated from each other by a designated distance along the edges of the cover panels 4057 and 4059, in substantially the same manner as the support rollers 4055. The rotation guides 4050 provided with the ball bearings 4155 instead of the support rollers 4055 do not require the installation part 4052, as shown in FIG. 16, and are easily installed.

Hereinafter, an operating process of the above-described dryer 1 in accordance with this embodiment will be described in detail with reference to the accompanying drawings. When a user operates the dryer 1, the drum driving device 4060 is operated to transmit a designated rotary force to the flexible drum 4040. The flexible drum 4040 receiving the rotary force transmitted from the drum driving device 4060 is rotated, with the front end and the rear end of the flexible drum 4040 tightly supported by the support rollers 4055 or the ball bearings 4155 of the rotation guides 4050, respectively, thereby tumbling laundry placed in the flexible drum 4040. Since the flexible drum 4040 is made of a flexible material, as described above, the flexible drum 4040 is rotatably supported by the rotation guides 4050 while maintaining a designated non-circular cross-section.

Although the embodiments of the present invention have been disclosed for illustrative purposes, those skilled in the art will appreciate that various modifications, additions and substitutions are possible, without departing from the scope and spirit of the invention as disclosed in the accompanying claims.

A clothes dryer in accordance with an embodiment as broadly described herein may include a flexible drum having an asymmetrical cross-section and rotatably provided in a main body rather than a drum having a circular cross-section so as to allow a greater amount of laundry to be placed therein.

Further, a clothes dryer in accordance with an embodiment as broadly described herein may allow a greater amount of laundry to be dried, and if the same amount of laundry is dried, shortens a drying time.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry machine, comprising:

a main body having an inner space formed therein;

a support body arranged in the main body to form a frame of the main body;

a flexible drum having an open front face and an open rear face, wherein the flexible drum is rotatably arranged on the support body so as to have a non-circular cross-section;

rotation guides arranged between the support body and the flexible drum, and contacting the flexible drum so as to rotate and support the flexible drum while maintaining the non-circular cross-section of the flexible drum as the flexible drum rotates; and a drum driving device installed to rotate the flexible drum, wherein each rotation guide comprises:

at least one rolling part rotatably installed on the support body so as to maintain rolling contact with an inner surface of the front end or the rear end of the flexible drum and exert an outward force on the flexible drum; and an installation part fixed to the support body such that the at least one rolling part is rotatably installed in the installation part, wherein the drum driving device comprises:

a driving motor installed in the inner space of the main body and generating a driving force;

a driving pulley connected to a rotary shaft of the driving motor and rotating in response to the driving force generated by the driving motor; and a rotary belt wound on the driving pulley and an outer circumferential surface of the flexible drum, wherein the rotary belt transmits the driving force of the driving motor to the flexible drum to rotate the flexible drum.

2. The laundry machine of claim 1, further comprising guide ribs disposed on the inner surfaces of the front end and the rear end of the flexible drum that engage the at least one rolling part to prevent separation of the flexible drum from the at least one rolling part as the flexible drum rotates.

3. The laundry machine of claim 2, wherein the guide ribs are disposed integrally with the flexible drum.

4. The laundry machine of claim 2, wherein the at least one rolling part comprises a guide groove that receives a corresponding guide rib therein.

5. The laundry machine of claim 1, wherein one end of the installation part surrounds the at least one rolling part except for a portion of the at least one rolling part contacting the flexible drum.

6. The laundry machine of claim 1, wherein the at least one rolling part includes:

a first rolling part contacting an inner surface of the front end or the rear end of the flexible drum and exerting an outward force on the flexible drum; and a second rolling part contacting an outer surface of the front end or the rear end of the flexible drum.

7. The laundry machine of claim 6, further comprising anti-separation protrusions formed at the front end and the rear end of the flexible drum to support the first rolling part and the second rolling part and prevent separation of the flexible drum from the rotation guides.

8. The laundry machine of claim 7, wherein the anti-separation protrusions are formed integrally with the flexible drum.

9. The laundry machine of claim 8, wherein one end of the installation part surrounds the first tolling part except for a portion of the first rolling part contacting the flexible drum.

10. The laundry machine of claim 1, wherein the drum driving device further comprises:

rotary members rotated together with the driving pulley; and rotary force transmission members connected with the rotary members to transmit the driving force of the driving motor.

11. The laundry machine of claim 10, wherein the rotary members include:

a first driving roller rotatably coupled to an outer surface of the flexible drum, and connected with the driving pulley by a first driving belt so as to be rotated together with the driving pulley; and a second driving roller rotatably coupled to the outer surface of the flexible drum, and connected with the first driving roller by a second driving belt so as to be rotated together with the first driving roller wherein the first driving roller and the second driving roller simultaneously contact the outer surface of the flexible drum as the first driving roller and the second driving roller rotate so as to rotate the flexible drum.

12. The laundry machine of claim 11, wherein the drum driving device further comprises a tensioner connecting a rolling part of one of the rotation guides to a part of the inner space of the main body to pull the rolling part toward the first driving roller and the second driving roller.

13. The laundry machine of claim 12, wherein the tensioner comprises an elastic member.

14. The laundry machine of claim 1, further comprising an anti-separation groove formed on the outer circumferential surface of the flexible drum that receives the rotary belt therein so as to prevent separation of the rotary belt from the flexible drum.

15. The laundry machine of claim 14, wherein the driving motor is installed in a lower portion of the inner space of the main body.

16. The laundry machine of claim 1, wherein the rotation guides receive and secure a front end and a rear end of the flexible drum in a forwards and a rearwards direction, respectively, and guide rotation of the flexible drum.

17. The laundry machine of claim 16, wherein each rotation guide includes a hooking space into which the front end or the rear end of the flexible drum is received and secured.

18. The laundry machine of claim 17, wherein the hooking space is formed between an outer hook terminal arranged so as to cover a part of an outer surface of the front end or the rear end of the flexible drum, and an inner hook terminal arranged so as to cover a part of an inner surface of the front end or the rear end of the flexible drum.

19. The laundry machine of claim 18, wherein each rotation guide further comprises a contact part installed at the front end or the rear end of the flexible drum, wherein the contact part is received and secured in the hooking space so as to move along the rotating route.

20. The laundry machine of claim 19, wherein the contact part is formed integrally with the flexible drum at the front end or the rear end of the flexible drum.

21. The laundry machine of claim 19, wherein a cross-section of the contact part corresponds to a cross-section of the hooking space.

22. The laundry machine of claim 21, wherein a slit, through which the flexible drum passes, is formed between the outer hook terminal and the inner hook terminal, and wherein a thickness of the contact part is greater than a height of the slit such that the contact part is caught in the hooking space formed by the outer hook terminal and the inner hook terminal.

23. The laundry machine of claim 19, wherein the contact part comprises:

a first roller rotatably installed on a rotary shaft passing through the front end or the rear end of the flexible drum so as to maintain rolling contact with the outer hook terminal; and a second roller installed on the rotary shaft so as to maintain rolling contact with the inner hook terminal.

24. The laundry machine of claim 22, further comprising a sealer provided on the inner hook terminal to prevent laundry or foreign substances generated by laundry received in the flexible drum from being caught in a gap between the flexible drum and the inner hook terminal.

25. The laundry machine of claim 1, further comprising geared protrusions formed on an outer circumferential surface of the flexible drum.

26. The laundry machine of claim 1, further comprising cover panels to cover the open front face and the open rear face of the flexible drum, respectively, wherein the rotation guides are arranged on the covet panels so as to support a front end and a rear end of the flexible drum as it rotates and guide rotation of the flexible drum.

27. The laundry machine of claim 26, wherein the rotation guides are arranged along respective edges of the cover panels.

28. The laundry machine of claim 27, wherein each rotation guide includes:

a contact terminal formed on each cover panel, the contact terminal contacting and supporting the front end or the rear end of the flexible drum; and a rotary device rotatably supporting an inner surface of the front end or the rear end of the flexible drum.

29. The laundry machine of claim 28, wherein the rotary device includes:

an installation part provided at an edge of each cover panel; and a plurality of support rollers rotatably installed in the installation part.

30. The laundry machine of claim 29, wherein the installation part is formed integrally as a recess in each cover panel so as to form a closed curve along the edge of each cover panel, and wherein the plurality of support rollers is arranged in the installation part so as to be separated from each other by a designated interval.

31. The laundry machine of claim 27, wherein each rotation guide includes:

a contact terminal formed on each cover panel, the contact terminal contacting and supporting the front end or the rear end of the flexible drum; and ball bearings rotatably supporting an inner surface of the front end or the rear end of the flexible drum.

32. The laundry machine of claim 31, further comprising a drum driving device installed in the inner space to rotate the flexible drum.

33. The laundry machine of claim 32, wherein the drum driving device comprises:

a driving motor installed in the inner space of the main body and generating a driving force;

a driving pulley connected to a rotary shaft of the driving motor and rotating in response to the driving force of the driving motor; and a rotary belt wound on the driving pulley and an outer circumferential surface of the flexible drum, wherein the rotary belt transmits the driving force of the driving motor to the flexible drum to rotate the flexible drum.

* * * * *